US011002433B2

(12) United States Patent
Ninomiya et al.

(10) Patent No.: US 11,002,433 B2
(45) Date of Patent: May 11, 2021

(54) LIGHT FIXTURE AND METHOD FOR MOUNTING LIGHT FIXTURE

(71) Applicant: Nichia Corporation, Tokushima (JP)

(72) Inventors: Susumu Ninomiya, Gosen (JP); Tetsutoshi Ishida, Niigata (JP)

(73) Assignee: Nichia Corporation, Anan (JP)

( * ) Notice: Subject to any disclaimer, the term of this patent is extended or adjusted under 35 U.S.C. 154(b) by 0 days.

(21) Appl. No.: 16/527,219

(22) Filed: Jul. 31, 2019

(65) Prior Publication Data

US 2020/0041106 A1 Feb. 6, 2020

(30) Foreign Application Priority Data

Jul. 31, 2018 (JP) ..... JP2018-143535
Dec. 28, 2018 (JP) ..... JP2018-248319

(51) Int. Cl.

| | |
|---|---|
| ***F21V 21/04*** | (2006.01) |
| ***F21V 21/03*** | (2006.01) |
| ***F21S 8/00*** | (2006.01) |
| ***F21V 15/01*** | (2006.01) |
| ***F21Y 105/14*** | (2016.01) |
| ***F21S 8/04*** | (2006.01) |

(52) U.S. Cl.

CPC ..... *F21V 21/044* (2013.01); *F21S 8/03* (2013.01); *F21S 8/04* (2013.01); *F21V 15/012* (2013.01); *F21V 21/03* (2013.01); *F21V 21/047* (2013.01); *F21Y 2105/14* (2016.08)

(58) Field of Classification Search

CPC ..... F21V 21/03; F21V 21/044; F21V 21/045; F21V 21/047; F21V 15/012; F21V 15/04; F21V 19/004; F21S 8/03; F21S 8/04; F21S 8/043; F21Y 2105/14; F21Y 2105/16

See application file for complete search history.

(56) References Cited

U.S. PATENT DOCUMENTS 6,685,339 B2 * 2/2004 Daughtry ..... H01R 33/94 362/249.05
7,771,085 B2 * 8/2010 Kim ..... H01R 33/9453 362/285

(Continued)

FOREIGN PATENT DOCUMENTS

JP 2013-134956 A 7/2013
JP 2014-103100 A 6/2014

(Continued)

*Primary Examiner* — Alan B Cariaso
(74) *Attorney, Agent, or Firm* — White & Case LLP

(57) ABSTRACT

A light fixture assembly for mounting on a mounting surface of a building material includes: a light fixture. The light fixture comprises a main body comprising a back side surface and a light transmissive side surface opposing the back side surface. The main body has a first dimension from a first lateral edge to a second lateral edge opposing the first lateral edge that is greater than a second dimension from the back side surface to the light transmissive side surface. The assembly further includes a mounting adapter provided at the back side surface, and a plate spring provided at the back side surface and extending along a first direction from the first lateral edge to the second lateral edge. The plate spring is configured to apply a restoring force to the first lateral edge and the second lateral edge.

20 Claims, 27 Drawing Sheets

(56) References Cited

U.S. PATENT DOCUMENTS

| | | | | |
|---|---|---|---|---|
| 8,057,058 | B2 * | 11/2011 | Cho | G02F 1/133608 349/64 |
| 8,281,497 | B2 * | 10/2012 | Takeba | F21V 19/009 34/70 |
| 8,648,979 | B2 * | 2/2014 | Kuromizu | G02F 1/133608 349/58 |
| 2008/0232116 | A1 * | 9/2008 | Kim | F21S 8/026 362/365 |
| 2014/0376227 | A1 * | 12/2014 | Schubert | F21V 23/009 362/249.02 |

FOREIGN PATENT DOCUMENTS

| | | | |
|---|---|---|---|
| JP | 2014-135151 | A | 7/2014 |
| JP | 2015-022932 | A | 2/2015 |
| JP | 2016-021296 | A | 2/2016 |
| JP | 2016-054122 | A | 4/2016 |
| JP | 6063926 | B2 | 1/2017 |

* cited by examiner

LIGHT FIXTURE AND METHOD FOR MOUNTING LIGHT FIXTURE

CROSS REFERENCE TO RELATED APPLICATIONS

This application claims priority to Japanese Patent Application No. 2018-143535 filed on Jul. 31, 2018, and Japanese Patent Application No. 2018-248319 filed on Dec. 28, 2018, the disclosures of which are hereby incorporated by reference in their entirety.

FIELD OF THE INVENTION

This disclosure described herein relate to a light fixture and a method of mounting a light fixture.

BACKGROUND

To mount, for example, a square lighting device in a ceiling, a method is performed in which a quadrilateral hole matching the shape and the size of a lighting main body is formed in the ceiling. The lighting main body is fixed to a suspension bolt, which is a ceiling component. Such light fixtures may be subject to drooping at theirs ends, allowing for the entrance of foreign matter into the back of the light fixture. Additionally, fixtures mounted in holes matching the size and shape of the fixture may be more likely to fall from their mounted positions.

SUMMARY OF THE INVENTION

In an aspect, a light fixture assembly for mounting on a mounting surface of a building material includes a light fixture having a main body, a mounting adapter, and a plate spring. The main body includes a back side surface and a light transmissive side surface opposing the back side surface. Further, the main body has a first dimension from a first lateral edge to a second lateral edge opposing the first lateral edge. The first dimension is greater than a second dimension from the back side surface to the light transmissive side surface. The mounting adapter is provided at the back side surface, and the plate spring extends along a first direction from the first lateral edge to the second lateral edge. The plate spring is configured to apply a restoring force to the first lateral edge and the second lateral edge.

In another aspect, a light fixture assembly for mounting on a mounting surface of a building material includes a light fixture having a main body, a mounting adapter, a plurality of light sources, and a plurality of protrusions. The main body includes a back side surface and a light transmissive side surface opposing the back side surface. The main body has a first dimension from a first lateral edge to a second lateral edge opposing the first lateral edge. The first dimension is greater than a second dimension from the back side surface to the light transmissive side surface. The mounting adapter is provided at the back side surface of the main body. The plurality of light sources is provided on a surface of the main body that is between the between the back side surface and the light transmissive side surface, and the plurality of light sources is arranged to emit light towards the light transmissive side surface. The plurality of protrusions is provided on the surface of the main body and arranged laterally between the plurality of light sources.

In another aspect, a method of mounting a light fixture includes fitting a tubular portion of a power supply adapter into a mounting hole formed in a building material, and disposing a power supply unit of the power supply adapter in a space backward of the building material. The power supply unit is provided above the tubular portion. A mounting adapter is fit into the tubular portion of the power supply adapter fitted into the mounting hole. The mounting adapter is provided at a back side surface of a light fixture main body, the light fixture main body including a light source module and a cover, the light source module including a plurality of light sources disposed in a region larger than a plane area of the mounting hole, the cover covering the light source module and being transmissive.

To provide an overall understanding of the systems, methods, and devices disclosed herein, certain illustrative embodiments will be described below. Although the embodiments and features described herein are specifically described for use in connection with a light fixture, it will be understood that the teachings may be adapted and applied to other mounting systems.

DETAILED DESCRIPTION OF THE INVENTION

Figure 1:
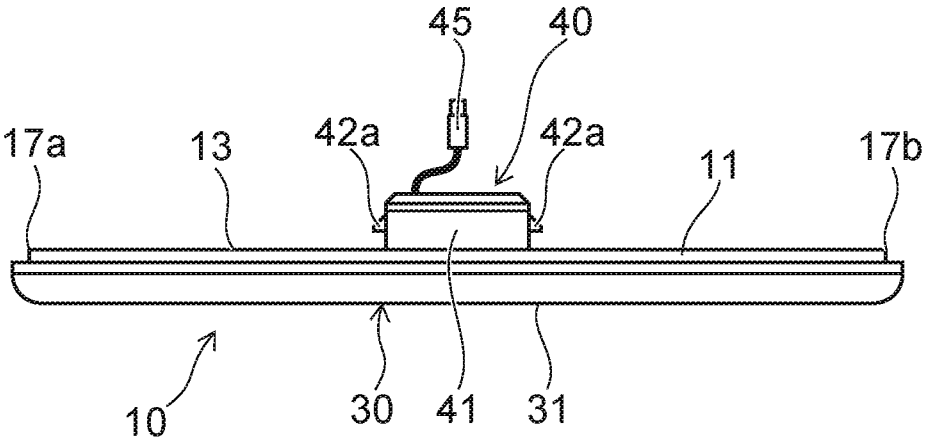
FIG. 1 is a side view of a light fixture main body and a mounting adapter of a first embodiment.

Embodiments of the present invention will be described below with reference to the drawings. In the drawings, the same reference numeral generally represents the same member.

FIG. 1 is a lateral side view of a light fixture main body 10 and a mounting adapter 40 of the first embodiment. Light fixture main body 10 has a first lateral edge 17*a* of light fixture main body 10 and a second lateral edge 17*b* of light fixture main body 10 that opposes the first lateral edge 17*a*. Light fixture main body 10 has a first dimension that extends from the first lateral edge 17*a* to the second lateral edge 17*b*. Light fixture main body 10 further has a back side surface 13 of base plate 11 and a light transmissive side surface 31. Light fixture main body has a second dimension that extends from the back side surface 13 to the light transmissive side surface. The first dimension is greater than the second dimension. The mounting adapter 40 is provided at the back side surface 13 of the base plate 11. The mounting adapter 40 is fixed to the back side surface 13 of the base plate 11. A DC (i.e., direct current) input connector 45 is connected to the mounting adapter 40.

Figure 2:
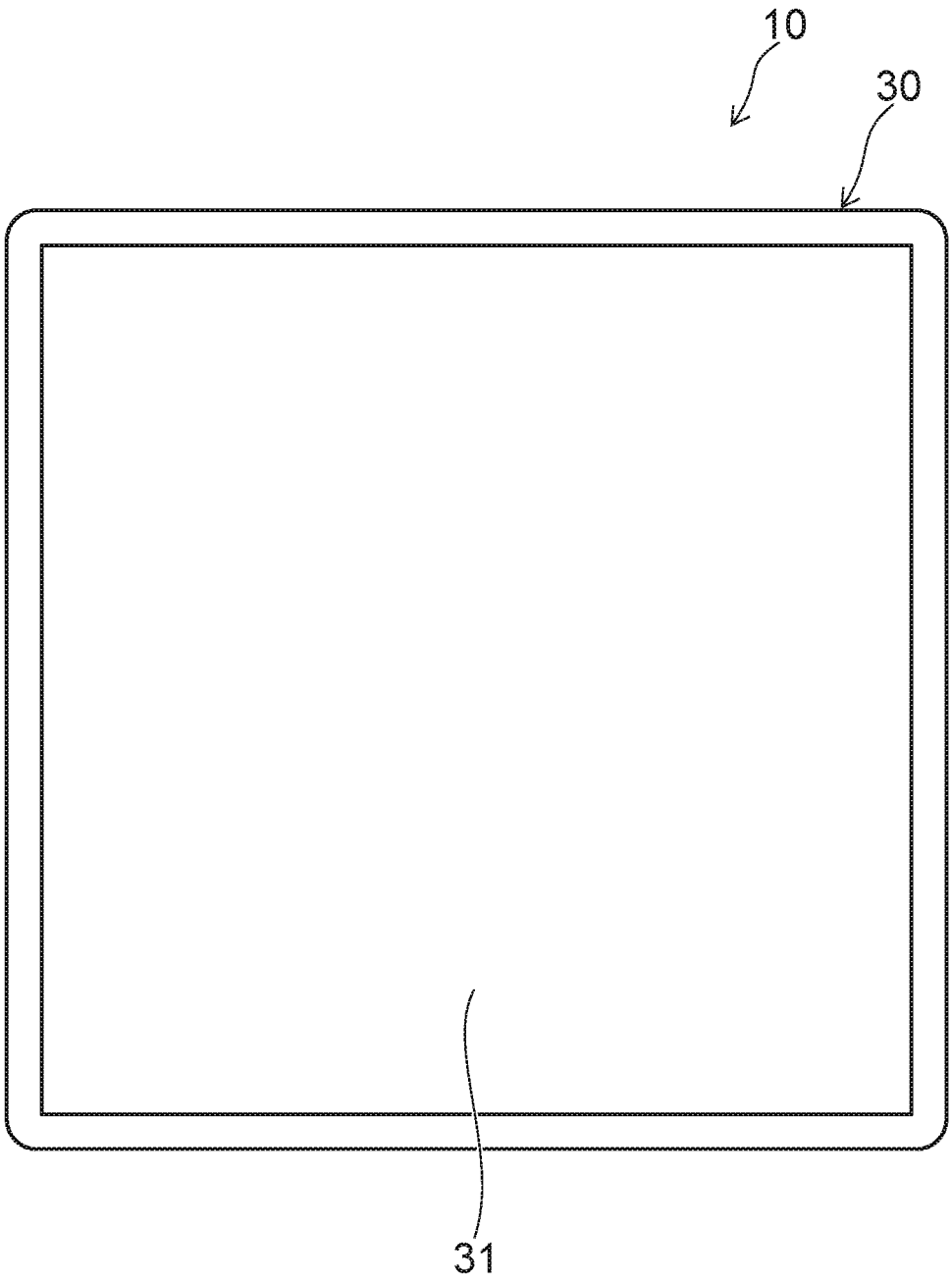
FIG. 2 is a front view of the light fixture main body of the first embodiment.

FIG. 2 is a front view of the light fixture main body 10. FIG. 2 shows quadrilateral light transmissive side surface of the cover 30.

Figure 3:
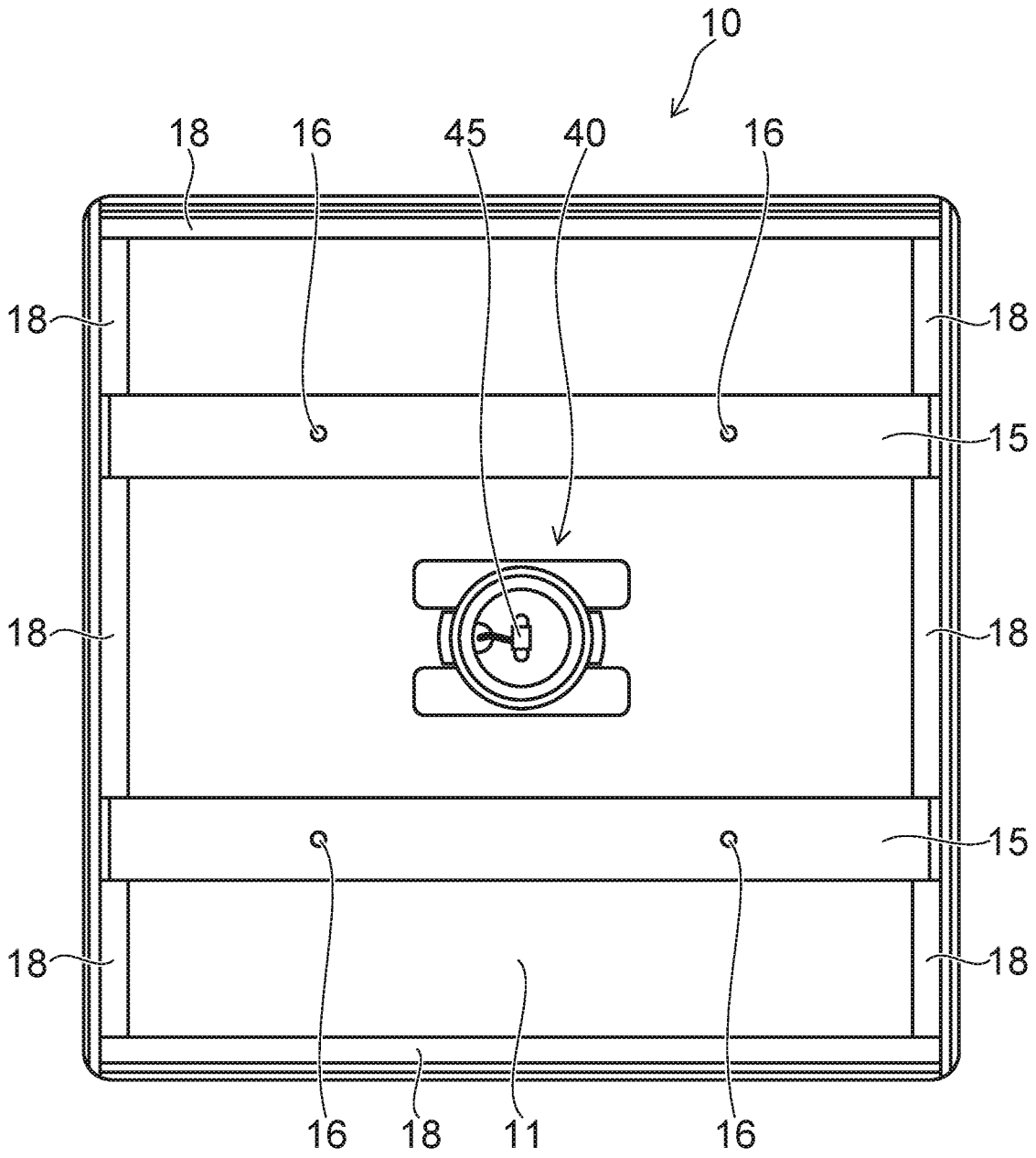
FIG. 3 is a rear view of the light fixture main body and the mounting adapter of the first embodiment.

FIG. 3 is a rear view of the light fixture main body 10 and the mounting adapter 40. The light fixture main body 10 includes a base plate 11 and a transmissive cover 30. As shown in FIG. 3, at least one plate spring 15 is provided at the back side surface 13 of the base plate 11. For example, two rectangular or strip-shaped plate springs 15 are provided at the back side surface 13 of the base plate 11. The plate springs 15 are, for example, glass-containing resin members. Each of the plate springs 15 is fixed to the back side surface 13 of the base plate 11 by two screws 16. The two screws 16 are separated from each other in the longitudinal direction of the plate springs 15 with the center in the longitudinal direction thereof interposed.

The two plate springs 15 extend parallel to each other along one side of the quadrilateral base plate 11. The two plate springs 15 are separated from each other in a direction orthogonal to the extension direction and are symmetrically arranged with respect to the mounting adapter 40 provided at the central portion of the base plate 11. A cushion material 18 is provided along the outer edge portion at the back side surface 13 of the base plate 11.

The light fixture main body 10 further includes a light source module 20.

Figure 4:
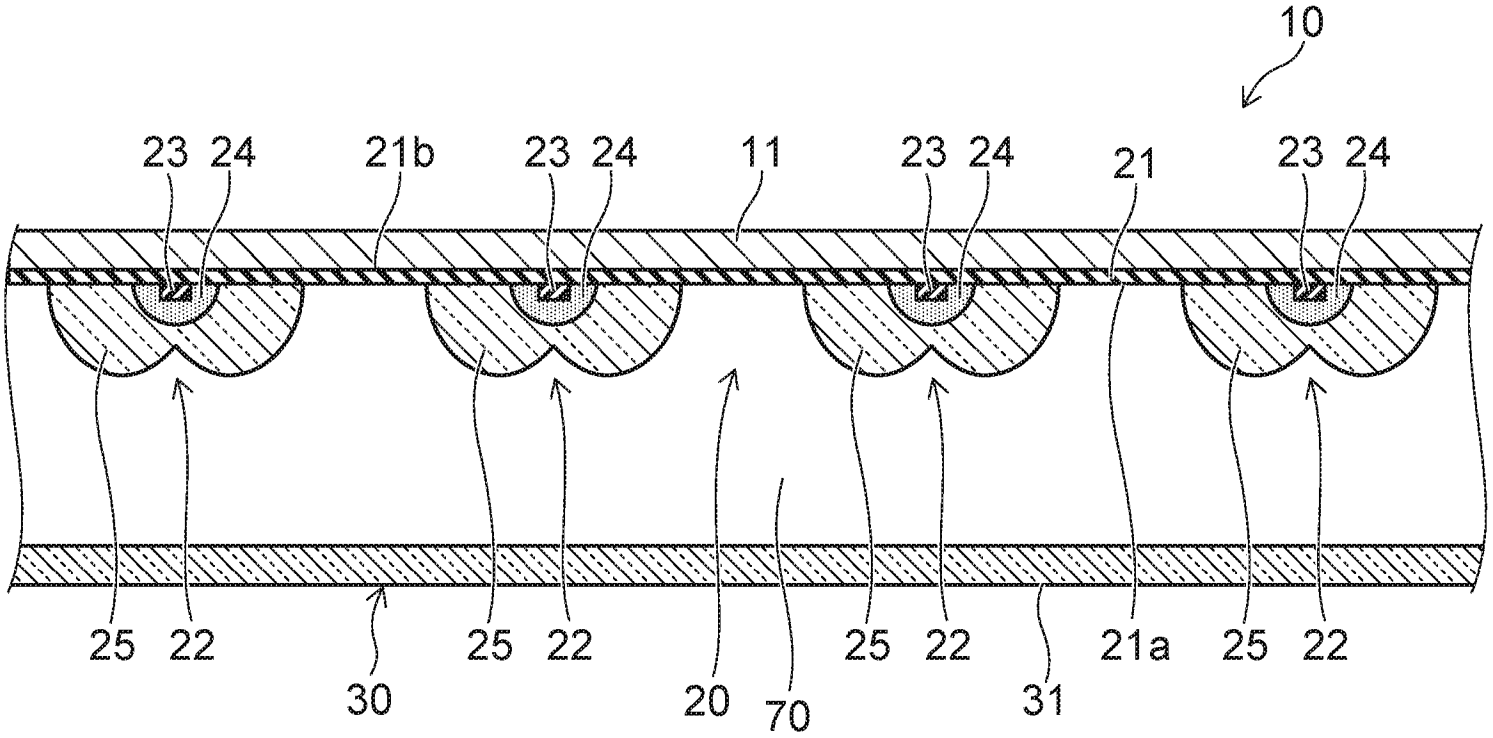
FIG. 4 is a schematic cross-sectional view of a light source module and a cover of the first and second embodiments.
Figure 5:
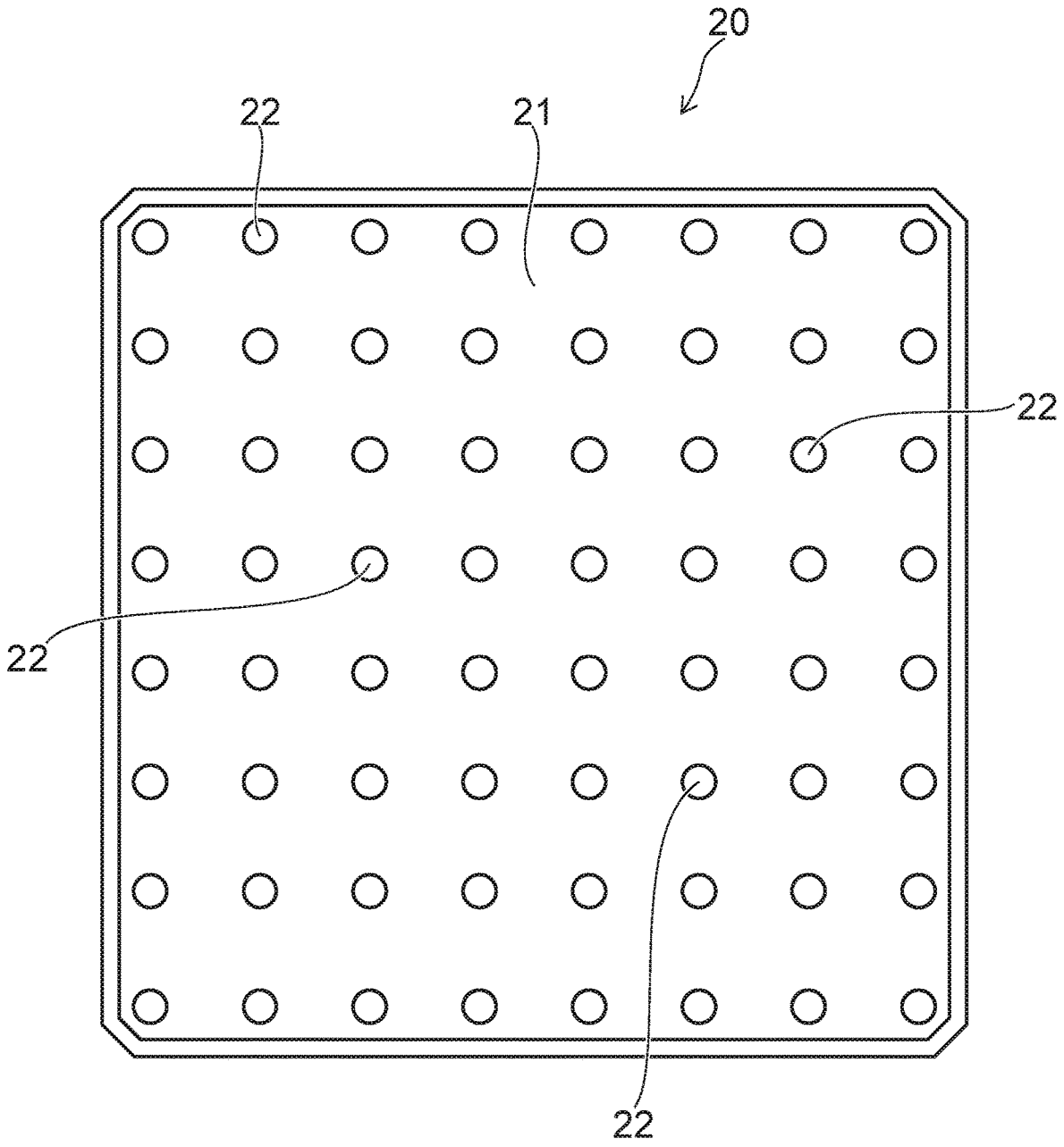
FIG. 5 is a front view of the light source module of the first embodiment.

FIG. 4 is a schematic cross-sectional view of the light source module 20 and the cover 30. FIG. 5 is a front view of the light source module 20.

Figure 27:
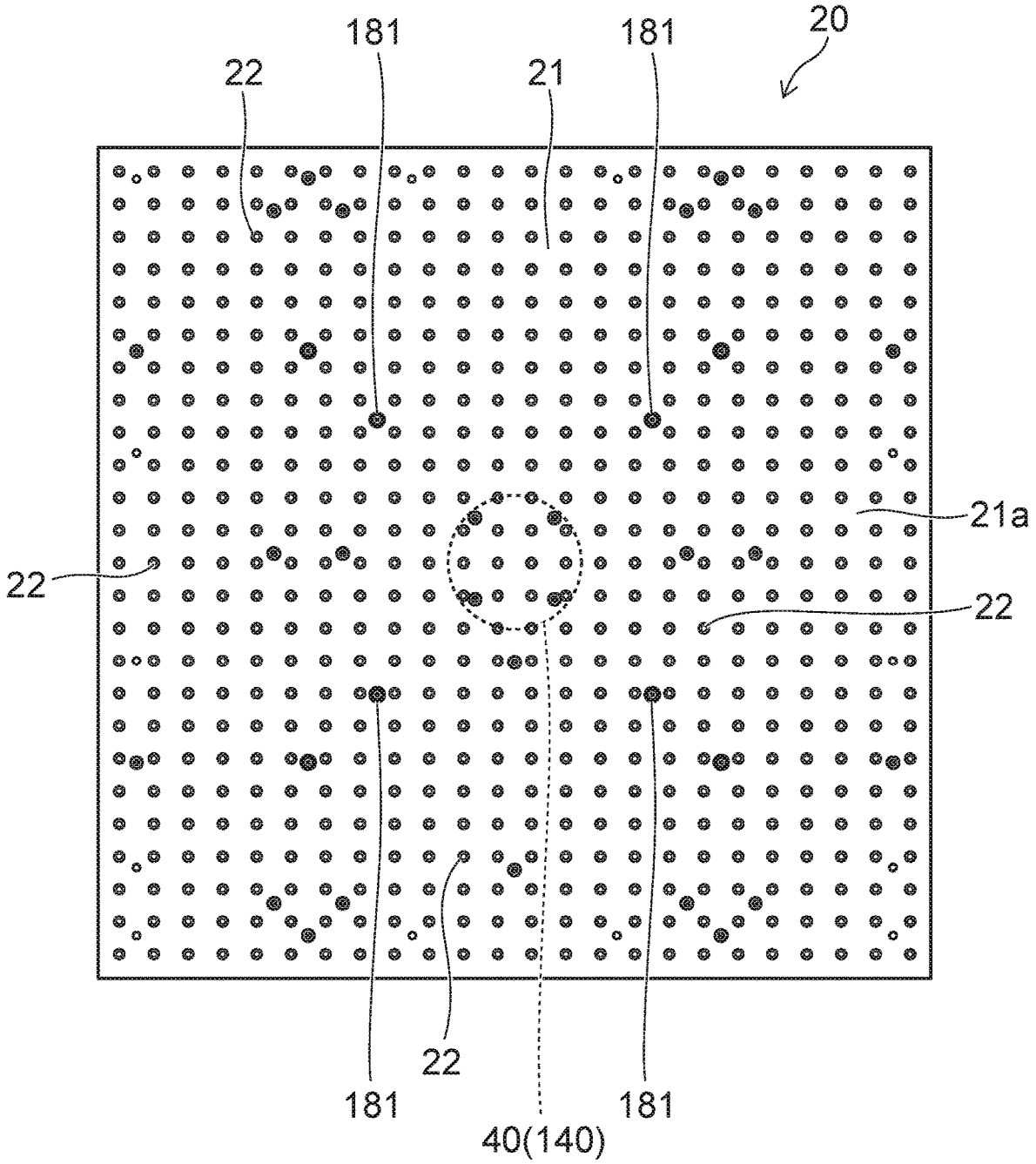
FIG. 27 is a front view of the light source module of the first and second embodiments.

FIG. 27 is a front view of another example of the light source module 20.

The light source module 20 is mounted to one surface of the base plate 11. The cover 30 is mounted to the base plate 11 to cover the light source module 20. The light transmissive side surface 31 of the cover 30 faces the light source module 20 and is separated from the light source module 20 by a space 70. The lateral surface portions of the cover 30 covers the side of the space 70. The base plate 11 is, for example, a metal plate and functions as a reinforcing plate and a heat dissipation plate of the light source module 20.

The light source module 20 includes a substrate 21 and multiple light sources 22. The substrate 21 has a light source arrangement surface 21*a*, and a back surface 21*b* on the side opposite to the light source arrangement surface 21*a*. The multiple light sources 22 are arranged periodically on the light source arrangement surface 21*a* of the substrate 21. In the examples shown in FIG. 5 and FIG. 27, the multiple light sources 22 are arranged in a lattice pattern having a constant pitch therebetween.

The substrate 21 may be, for example, an insulating substrate formed using a resin or a ceramic. A conductor pattern is formed in the light source arrangement surface 21*a*. Each of the light sources 22 includes, for example, one or more light-emitting elements 23 such as an LED (i.e., Light Emitting Diode) or the like, a phosphor layer 24, and a resin member 25. The light-emitting elements 23 are mounted in the light source arrangement surface 21*a* of the substrate 21; and the electrodes of the light-emitting elements 23 are electrically connected to the conductor pattern formed in the substrate 21.

The phosphor layer 24 covers the light-emitting elements 23. The resin member 25 covers the phosphor layer 24. The portions of the resin member 25 covering the centers and their vicinity of the upper surface of each of the light-emitting elements 23 are concave. The resin member 25 having such a configuration can function as a lens that allows the light source 22 to provide a batwing light distribution.

Figure 6:
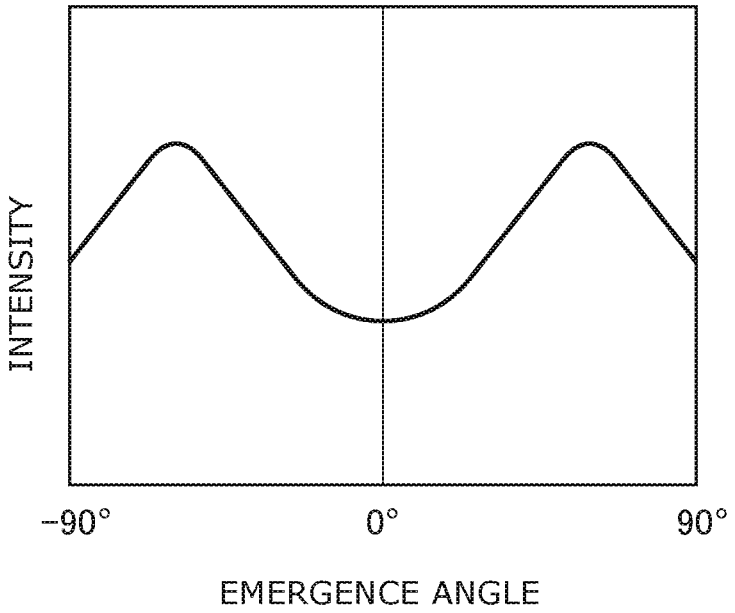
FIG. 6 is a light distribution characteristic chart of the first and second embodiments.

FIG. 6 shows an example of the batwing light distribution. The horizontal axis indicates the angle of the light emitted from the light source 22. The 0° indicates the direction that is perpendicular to the light source arrangement surface where the light source 22 is disposed. The vertical axis indicates the intensity of the light emitted from the light source 22.

The batwing light distribution is a light distribution characteristic that has a first intensity peak and a second intensity peak. The first intensity peak is a peak of the light emission in the range of a 0° to −90° emission angle, and is larger than the intensity of the 0° emission angle. The second intensity peak is a peak of the light emission in the range of a 0° to 90° emission angle, and is larger than the intensity of the 0° emission angle.

Because the light source 22 has a batwing light distribution, even if the distance between the light sources 22 and the cover 30 is short according to the reduction in the thickness of the light fixture main body 10, light emission surface with less non-uniformity of luminance can be obtained (i.e., substantially uniform light emission can be obtained). Also, when the light transmissive side surface 31 of the cover 30 is part of the visual field of a human, the human is less likely to sense that the light sources 22 comprise concentrated areas of light that are too bright.

The cover 30 is transmissive to the light emitted by the light sources 22. For example, the cover 30 is a light-diffusing translucent white member in which titanium oxide or the like is dispersed in a resin material. The cover 30 is flexible.

In addition to the light fixture main body 10 and the mounting adapter 40 described above, the light fixture of the embodiment includes a power supply adapter 50.

Figure 7:
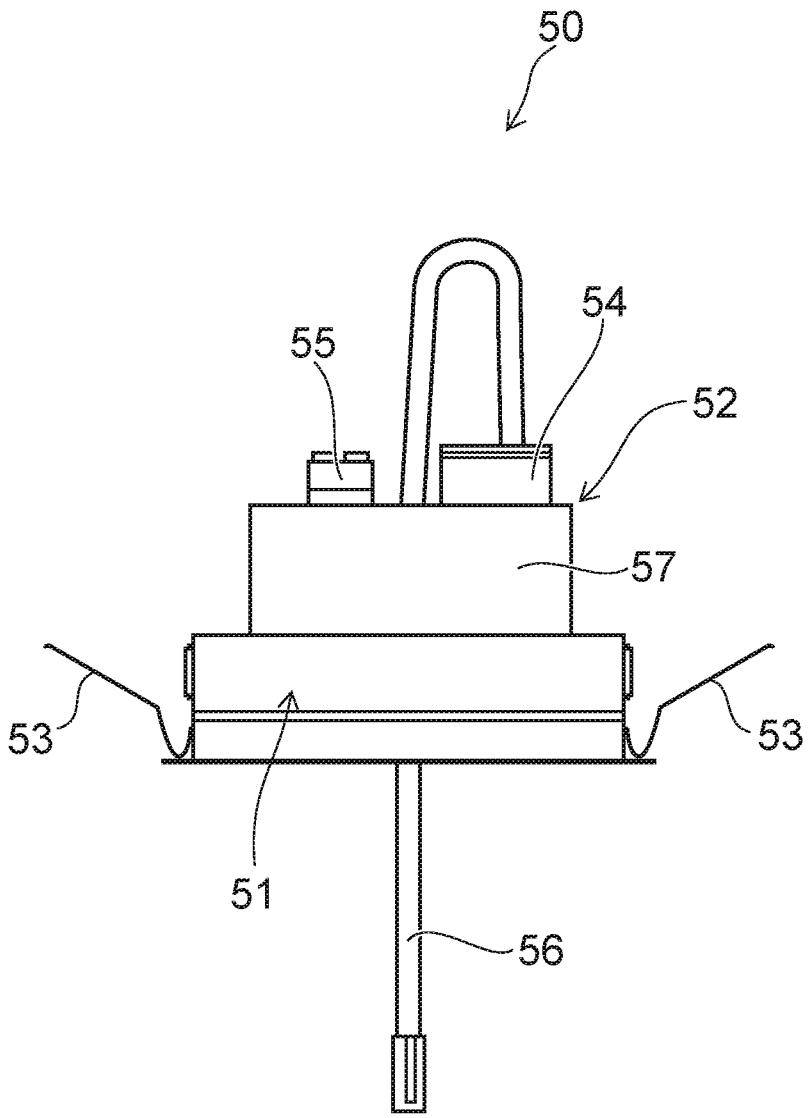
FIG. 7 is a lateral side view of a power supply adapter of the first embodiment.

FIG. 7 is a side view of the power supply adapter 50.

The power supply adapter 50 includes a housing 51, and a power supply unit 52 provided above the housing 51. In some embodiments, the housing 51 has a cylindrical cross-section in the horizontal direction, i.e. in the direction parallel to the back side surface (for example, back side surface 13 of FIG. 1 or back side surface 21*b* of FIG. 4). The housing 51 has a height larger than its width. In some embodiments, the housing 51 comprises a tubular portion. Multiple mounting springs 53 that have plate-spring structures are provided on the lateral surface of the housing 51.

A power supply is incorporated into the interior of a casing 57 of the power supply unit 52. An AC (i.e., alternating current) input terminal block 54 and a dimming terminal block 55 are provided at the upper surface of the casing 57. A DC cable 56 is connected to the AC input terminal block 54. The DC cable 56 passes through the interior of the casing 57 and the interior of the housing 51.

The light fixture of the embodiment described above is detachably mounted to a building material such as a ceiling, a wall material, etc. An example in which the light fixture is mounted to a ceiling will now be described with reference to FIG. 8 to FIG. 13.

Figure 8:
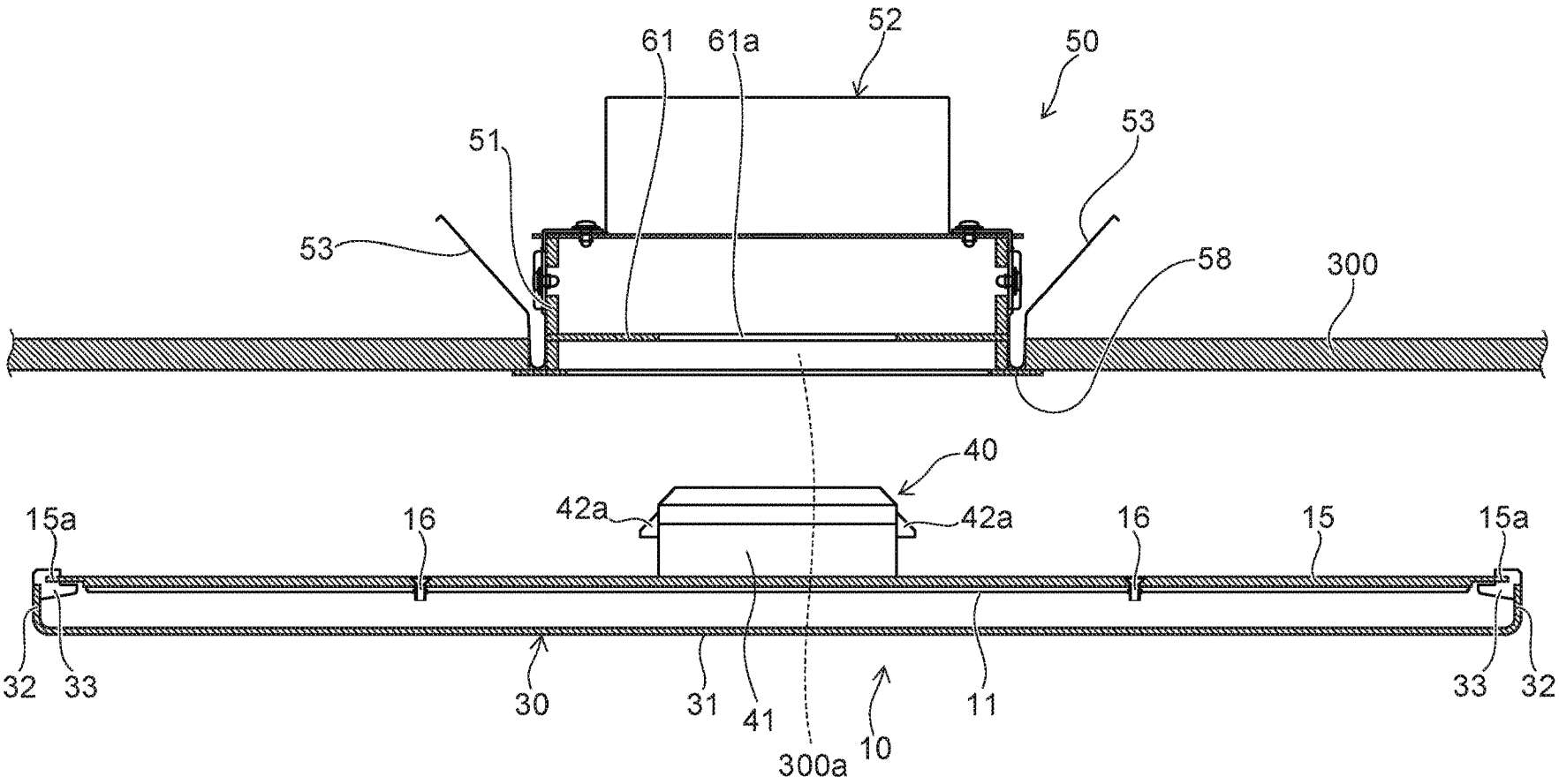
FIG. 8 to FIG. 13 are schematic cross-sectional views illustrating a method of mounting the light fixture of the first embodiment to a building material.
Figure 11:
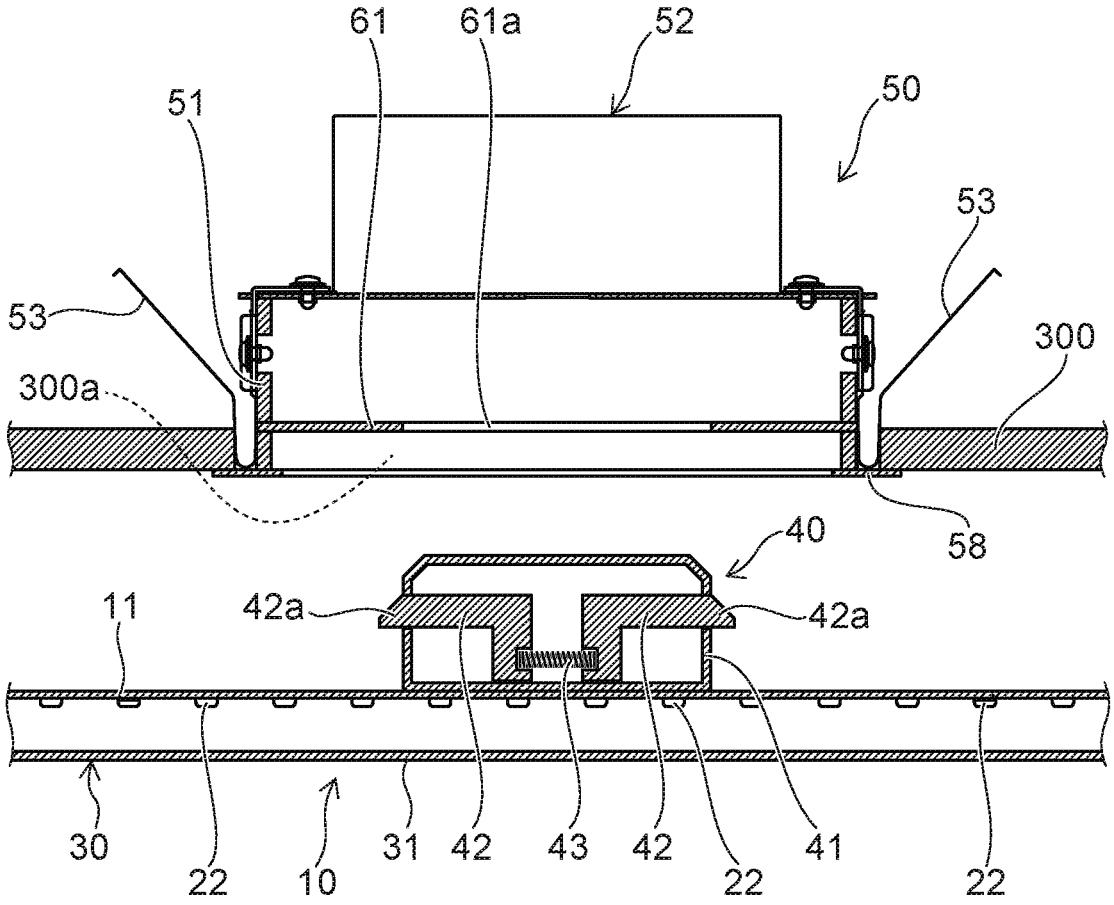

FIG. 8 and FIG. 11 illustrate a state in which the power supply adapter 50 is mounted to a ceiling 300, and the mounting adapter 40 and the light fixture main body 10 are not mounted to the ceiling 300.

The housing 51 of the power supply adapter 50 is formed in a cylindrical shape. A mounting hole 300*a* having a circular shape is formed in the ceiling 300. The housing 51 of the power supply adapter 50 is fitted into the mounting hole 300*a* formed in the ceiling 300. The mounting springs 53 are positioned between the lateral surface of the housing 51 and the inner wall of the mounting hole 300*a* in a state in which the mounting springs 53 are deformed from the unstressed state. The state in which the housing 51 is fitted into the mounting hole 300*a* is maintained by the restoring force of the mounting springs 53.

The back surface of a flange 58 provided on the outer perimeter at the lower-end of the opening in the housing 51 is in contact with the ceiling surface at the vicinity of the mounting hole 300*a*. The housing 51 extends above the flange 58 in cross-sectional views. The power supply unit 52 provided above the housing 51 is disposed in the space on the backside of the ceiling 300. The power supply unit 52 does not protrude into the space below the ceiling 300.

In the light fixture main body 10 as shown in FIG. 8, end portions 15*a* in the longitudinal direction of the plate springs 15 are respectively inserted and bonded to end portions 33 of the cover 30. The end portions 33 of the cover 30 are provided at the tips of lateral surface portions 32 and extend in a direction from the light transmissive side surface 31 toward the back side surface of base plate 11 (for example, back side surface 13 of FIG. 1 or back side surface 21*b* of FIG. 4).

In the state in which the light fixture main body 10 and the mounting adapter 40 are not mounted to the power supply adapter 50, the end portions 33 of the cover 30 bonded to the end portions 15*a* of the plate springs 15 protrude from a plane coplanar with the back surfaces of the plate springs 15. In this state, the plate springs 15 are substantially flat and are in the unstressed state or substantially the unstressed state.

As shown in FIG. 11, the mounting adapter 40 also includes a case 41, two sliding members 42 provided inside the case 41, and a spring 43 linking the two sliding members 42. A tab portion 42*a* having an inclined surface is provided at the tip of each of the sliding members 42. By the two sliding members 42 sliding as the spring 43 expands and contracts, the tab portions 42*a* can retract into the case 41 and can protrude outside the case 41 via through-holes 44 (illustrated in FIG. 12) formed on the lateral surfaces of the case 41. As shown in FIG. 11, the tab portions 42*a* protrude outside the case 41 when the spring 43 is in the unstressed state.

An engaging member 61 having a plate shape is provided inside the housing 51 of the power supply adapter 50. An engaging hole 61*a* is formed in the engaging member 61. The diameter of the engaging hole 61*a* is smaller than the inner diameter of the housing 51 and larger than the outer diameter of the case 41 of the mounting adapter 40.

The light fixture main body 10 is mounted to the ceiling 300 by fitting the mounting adapter 40 provided at the back side surface of the light fixture main body 10 (for example, back side surface 13 of FIG. 1 or back side surface 21*b* of FIG. 4) into the housing 51 of the power supply adapter 50 fitted into the mounting hole 300*a* of the ceiling 300.

Figure 12:
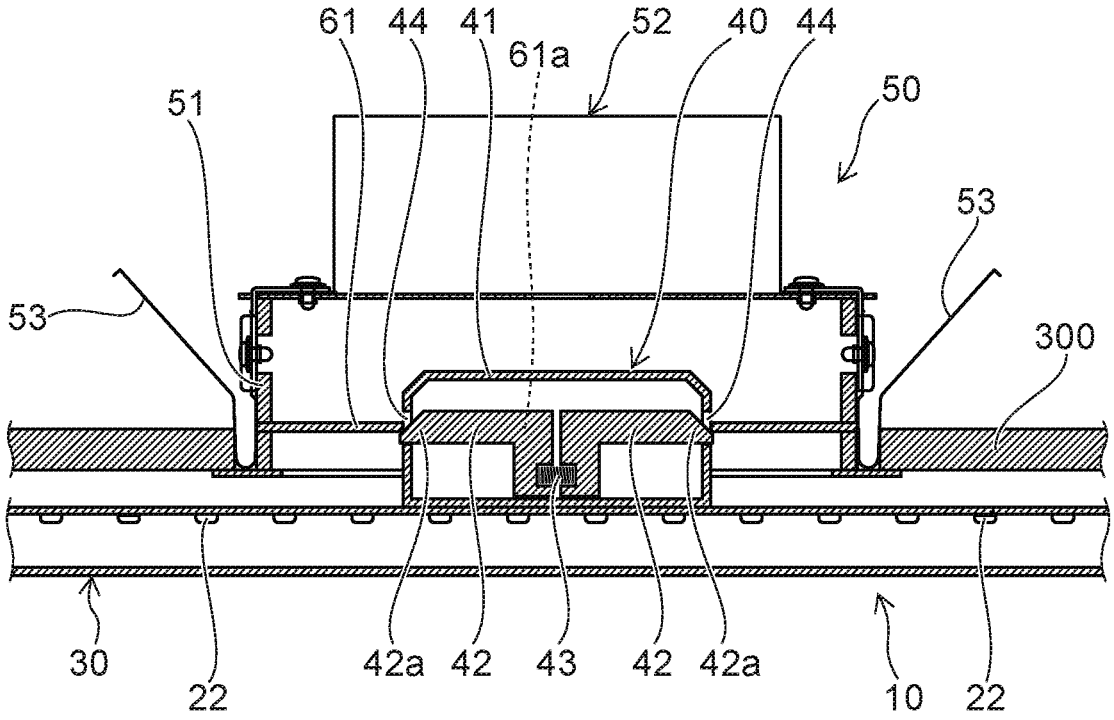

As shown in FIG. 12, the inclined surfaces of the tab portions 42*a* are in contact with the inner wall of the engaging hole 61*a* when the case 41 of the mounting adapter 40 is fitted into the engaging hole 61*a* formed in the engaging member 61 of the power supply adapter 50. By additionally pressing the mounting adapter 40 into housing 51 in the direction towards the mounting surface, the forces on the tab portions 42*a* from the inner wall of the engaging hole 61*a* compress the spring 43 and cause the two sliding members 42 to slide to approach each other. The tab portions 42*a* retract into the case 41, which allows the mounting adapter 40 to be pressed further.

Figure 13:
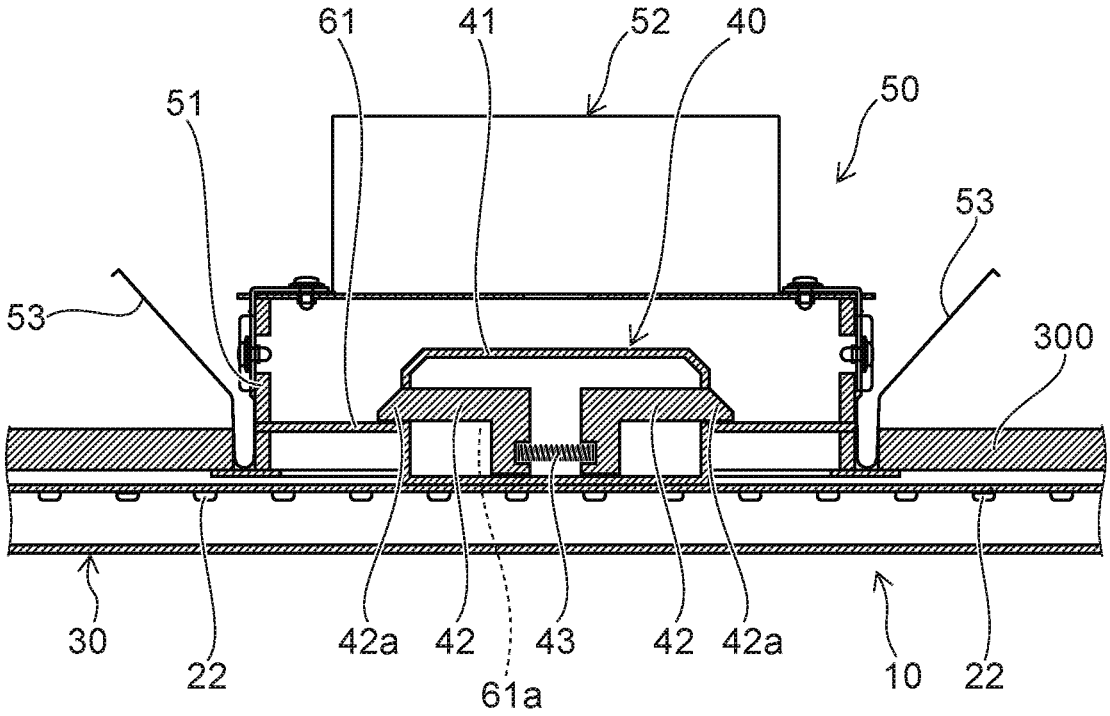

Then, after the tab portions 42*a* are moved to a position higher (in the drawing) than the engaging member 61, the forces applied on the tab portions 42*a* from the inner wall of the engaging hole 61*a* are released. The two sliding members 42 are moved away from each other by the restoring force of the spring 43. The tab portions 42*a* protrude outside the case 41, and the lower surfaces of the tab portions 42*a* extend on the upper surface of the engaging member 61 at the vicinity of the engaging hole 61*a* as shown in FIG. 13. This reduces the possibility that the mounting adapter 40 and the light fixture main body 10 fixed to the mounting adapter 40 fall from the power supply adapter 50.

Before the mounting adapter 40 is fitted into the power supply adapter 50, the DC (i.e., direct current) input connector 45 on the mounting adapter 40 side shown in FIG. 1 and FIG. 3 is connected to the DC cable 56 on the power supply adapter 50 side shown in FIG. 7. Thus, electrical power is supplied from a commercial power source to the light sources 22 via the power supply unit 52. The alternating current power of the commercial power source is converted into direct current power by the power supply unit 52 and is supplied to the light sources 22.

The plate springs 15 provided at the back side surface of the light fixture main body 10 (for example, back side surface 13 of FIG. 1 or back side surface 21*b* of FIG. 4) undergo elastic deformation when the mounting adapter 40 described above is fitted into the power supply adapter 50.

Figure 9:
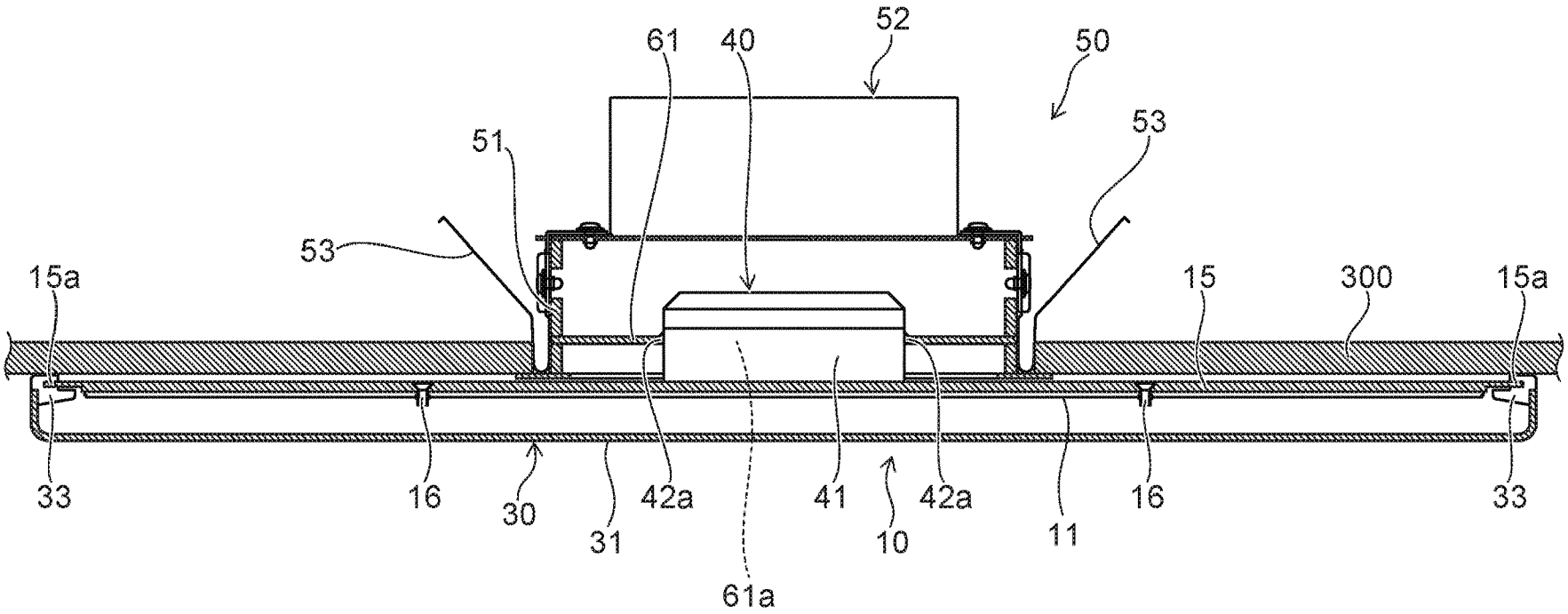

FIG. 9 illustrates an intermediate state of pressing the mounting adapter 40 into the engaging hole 61*a* of the power supply adapter 50. As described above, the end portions 33 of the cover 30 that is bonded to the end portions 15*a* of the plate springs 15 protrude from a plane coplanar with the back surfaces of the plate springs 15. Therefore, as the light fixture main body 10 approaches the ceiling surface, the end portions 33 of the cover 30 contact the ceiling surface before the plate springs 15. At this time, the plate springs 15 are still in a flat state, and there is a gap between the ceiling surface and the back surfaces of the plate springs 15. From this state, the mounting adapter 40 is completely fitted into the engaging hole 61*a* of the power supply adapter 50 while deforming the plate springs 15. Accordingly, the light fixture main body 10 is pressed onto the ceiling surface by the restoring force of the deformed plate springs 15.

Figure 10:
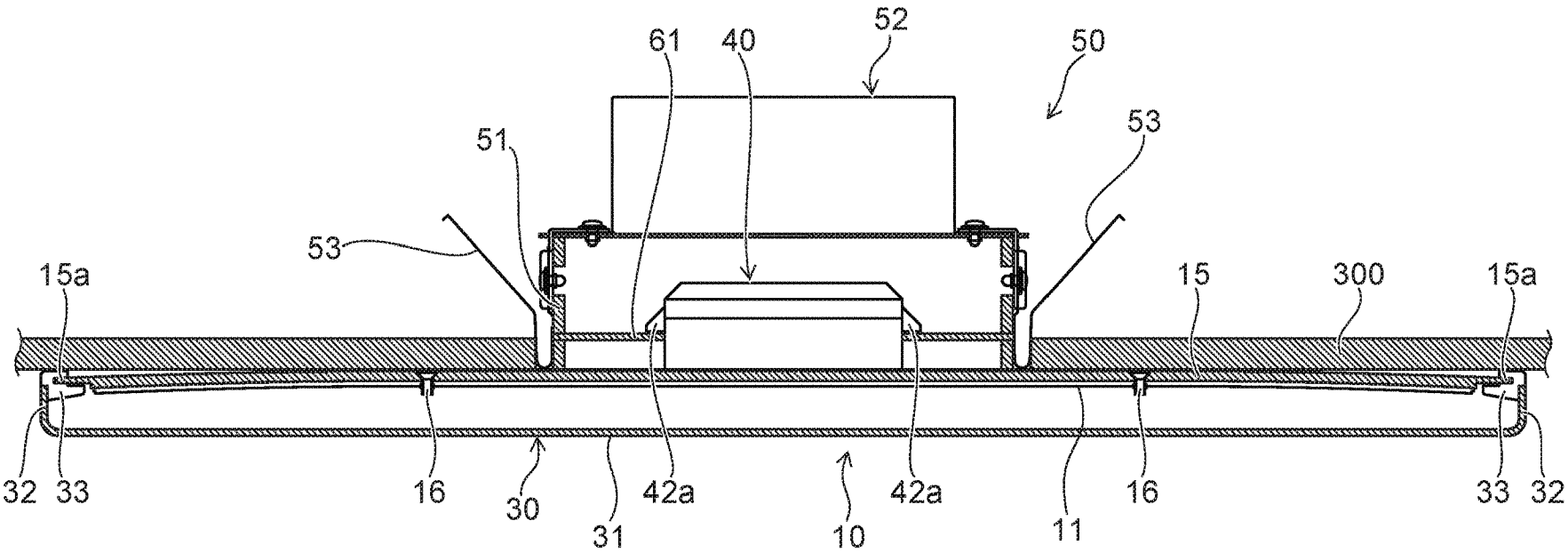

In other words, when the mounting adapter 40 is pressed into the housing 51 of the power supply adapter 50 in the direction towards the mounting surface from the state of FIG. 9, the plate springs 15 are deformed using the portions fixed by the screws 16 to the base plate 11 as fulcrums as shown in FIG. 10. FIG. 10 shows a state in which the mounting adapter 40 is completely fitted into the engaging member 61 of the power supply adapter 50. In this state, the portions of the plate springs 15 fixed by the screws 16 are in contact with the ceiling surface, and the portions of the plate springs 15 closer to the end portion 15*a* warp downward using the screws 16 as fulcrums. Accordingly, a restoring force to return to the flat state acts on the portions of the plate springs 15 closest to the end portion 15*a*, thereby allowing the end portions 33 of the cover 30 bonded to the end portions 15*a* of the plate springs 15 to move in a direction pressing toward the ceiling surface.

In the case where the planar size of the light fixture main body 10 is large, the end portion of the light fixture main body 10 easily droops downward due to its own weight compared to the central portion of the light fixture main body 10 which is directly held by the mounting adapter 40 to the power supply adapter 50. According to the embodiment, the end portions 33 of the cover 30 can be securely in contact with the ceiling surface by the restoring force of the plate springs 15 even in the case where the light fixture main body 10 has a large surface area. This can reduce a possibility that foreign substances enter into the backside of the light fixture main body 10 (i.e., the gap at the ceiling surface).

In the state in which the light fixture main body 10 is mounted to the power supply adapter 50, the cushion material 18 that is provided at the outer edge portion of the back side surface of the base plate 11 shown in FIG. 3 (for example, back side surface 13 of FIG. 1 or back side surface 21*b* of FIG. 4) is between the base plate 11 and the ceiling surface and is in close contact with both the base plate 11 and the ceiling surface. Thus, a gap is less likely to be formed at the outer edge portion of the light fixture main body 10. The restoring force of the plate springs 15 recited above can also increase the adhesion of the cushion material 18 to the ceiling surface.

As shown in FIG. 10 and FIG. 13, the light fixture main body 10 is mounted, via the mounting adapter 40, to the power supply adapter 50 fitted into the ceiling 300. In this state, the light transmissive side surface 31 of the cover 30 is substantially parallel to the ceiling surface, and faces the space below the ceiling surface.

Alternatively, the light fixture of the embodiment can be mounted to a wall material by a method similar to the method of mounting to the ceiling recited above. When the light fixture main body 10 is mounted to a wall material, the light transmissive side surface 31 of the cover 30 is substantially parallel to the wall surface, and faces the space beside the wall surface.

The multiple light sources 22 of the light source module 20 are arranged over a region that is larger than the surface area of the mounting hole 300*a* formed in the ceiling 300 and the opening plane area in the housing 51 of the power supply adapter 50. The light sources 22 are disposed also in the region of the light fixture main body 10 overlapping the mounting adapter 40 in a top view of the light fixture main body 10. This enables light emission from the central portion of the light transmissive side surface 31, which is the region overlapping the mounting hole 300*a*, and the mounting adapter 40 in the top view, thereby allowing for a light-emitting surface having a wide surface area.

According to the embodiment described above, it is unnecessary to make a polygonal hole matching the shape and the size of the light fixture main body 10 in the building material. Also, when mounting in the building material, it is sufficient to make only one mounting hole that is smaller than the size of the light fixture main body 10 and matches the size of the power supply adapter 50. The power supply adapter 50 can be easily attached to and detached from the mounting hole by a one-touch operation utilizing the mounting springs 53. By attaching and removing the mounting adapter 40 to and from the power supply adapter 50 by one-touch operation, the light fixture main body 10 can be attached to and detached from the building material. According to such an embodiment, the number of process steps when mounting the light fixture to the building material can be reduced to relatively great extent.

With this configuration, several product types of the light fixture main body 10 can be easily attached to and detached from the common power supply adapter 50 by a one-touch operation. Thus, the replacement to other types of the light fixture main body 10 is possible with less time and effort. When replacing the light fixture main body 10, it is unnecessary to detach the common power supply adapter 50 from the building material, and it is sufficient to attach or remove only the light fixture main body 10 to or from the power supply adapter 50 via the mounting adapter 40.

A second embodiment of the present disclosure will now be described.

Figure 14:
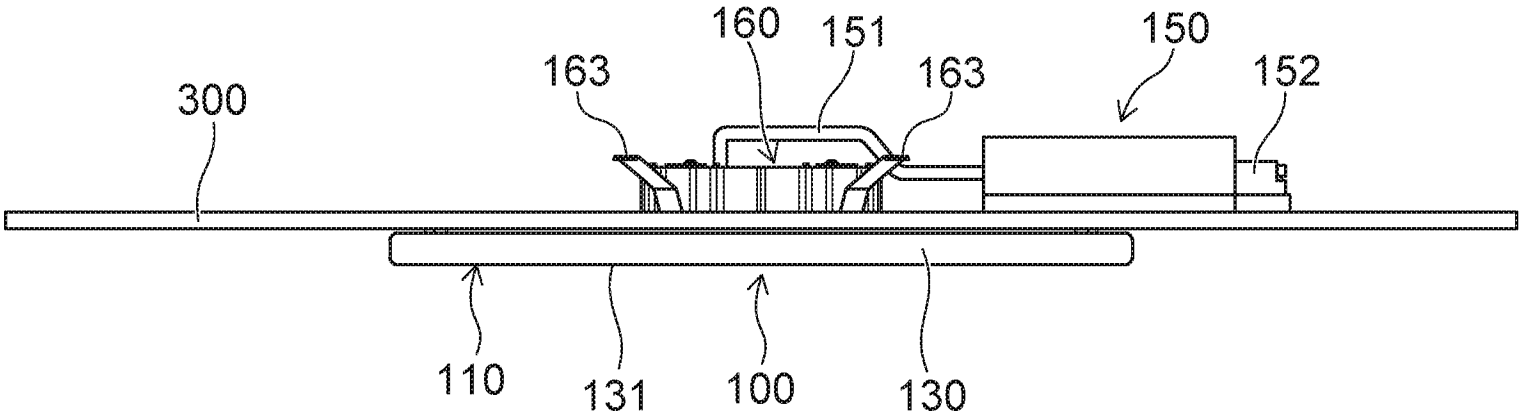
FIG. 14 is a side view illustrating a state in which a light fixture of the second embodiment is mounted to a ceiling.

FIG. 14 is a lateral side view illustrating a state in which a light fixture 100 of the second embodiment is mounted to a building material, which is, for example, the ceiling 300.

Figure 15:
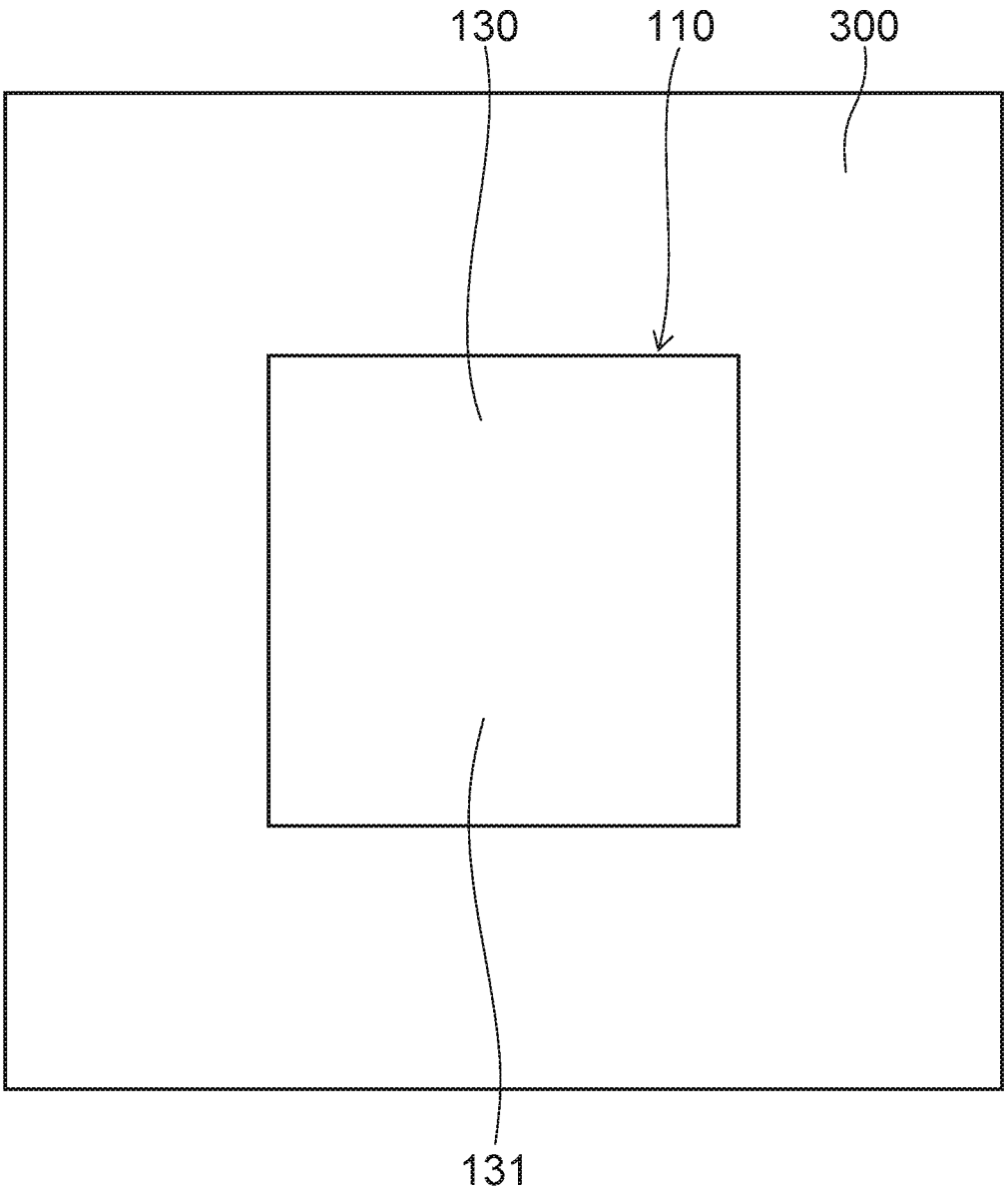
FIG. 15 is a plan view of a light transmissive side surface of the light fixture of the second embodiment.

FIG. 15 is a plan view of the light transmissive side surface of the light fixture 100 mounted to the ceiling 300.

Figure 16:
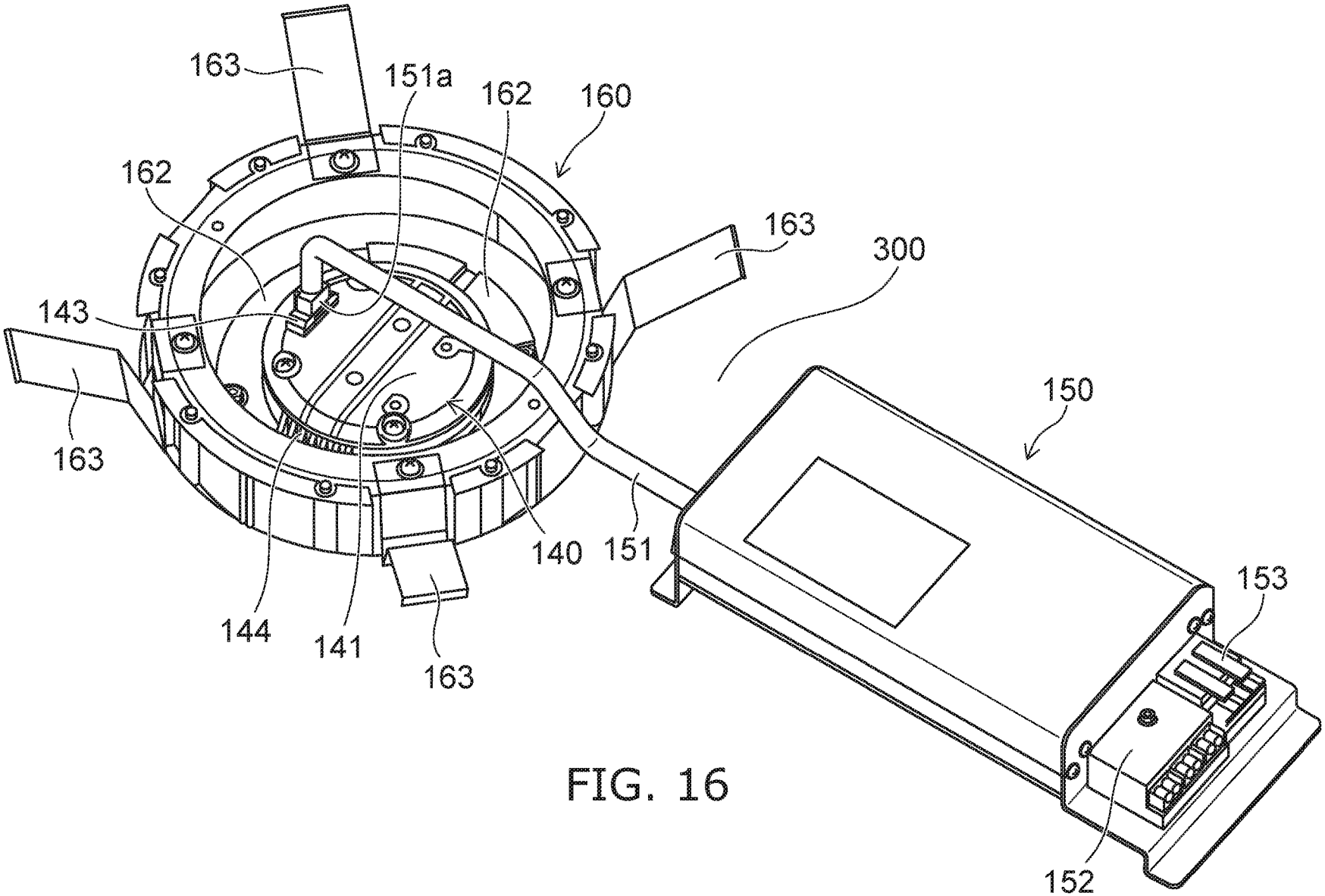
FIG. 16 is a perspective view of components shown in FIG. 14 that are positioned on a backside of the ceiling.

FIG. 16 is a perspective view of the components shown in FIG. 14 that are positioned on the backside of the ceiling 300.

Figure 17:
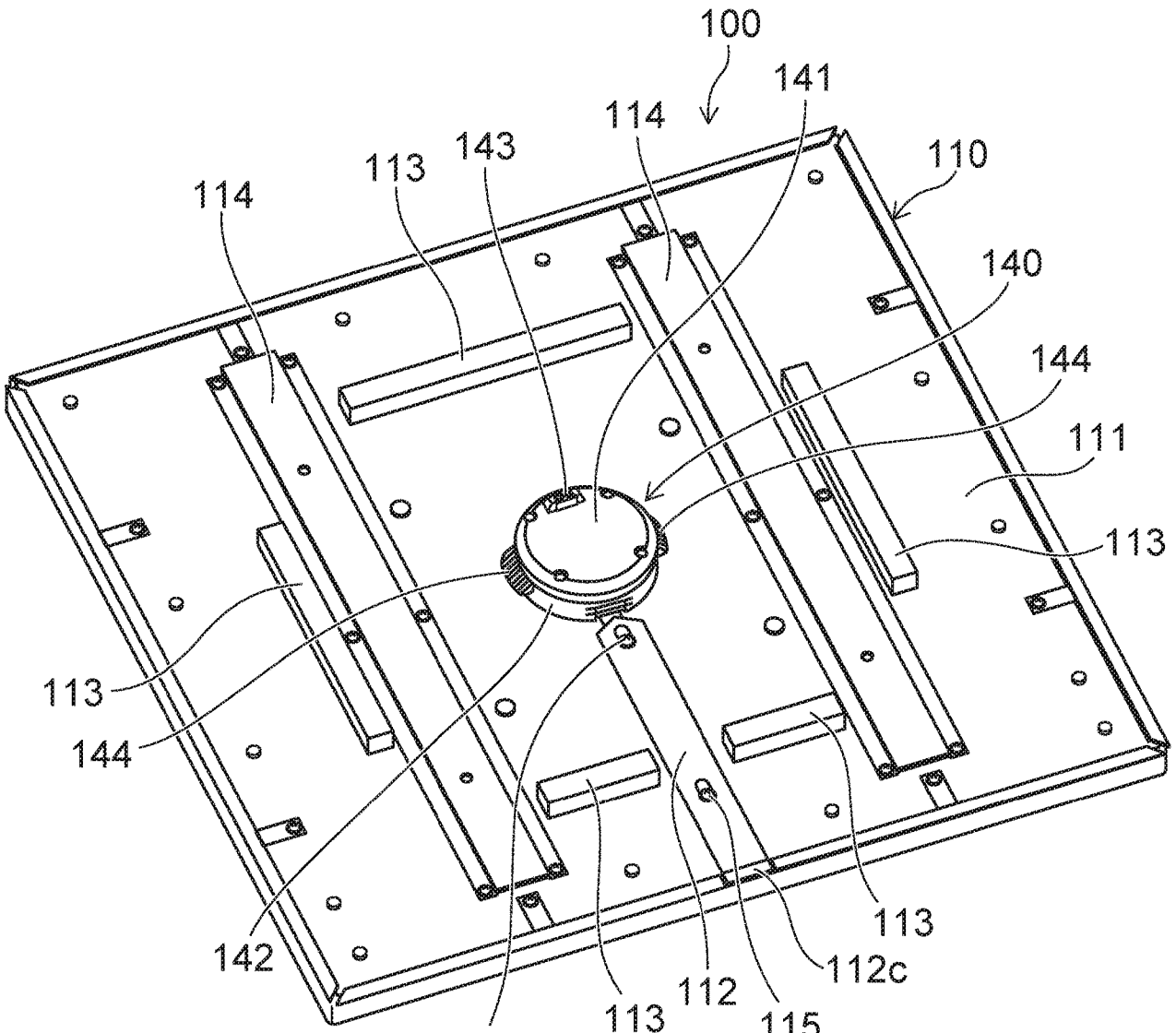
FIG. 17 is a perspective view of a back side surface of the light fixture of the second embodiment.

FIG. 17 is a perspective view of the back side surface of the light fixture 100.

Figure 18:
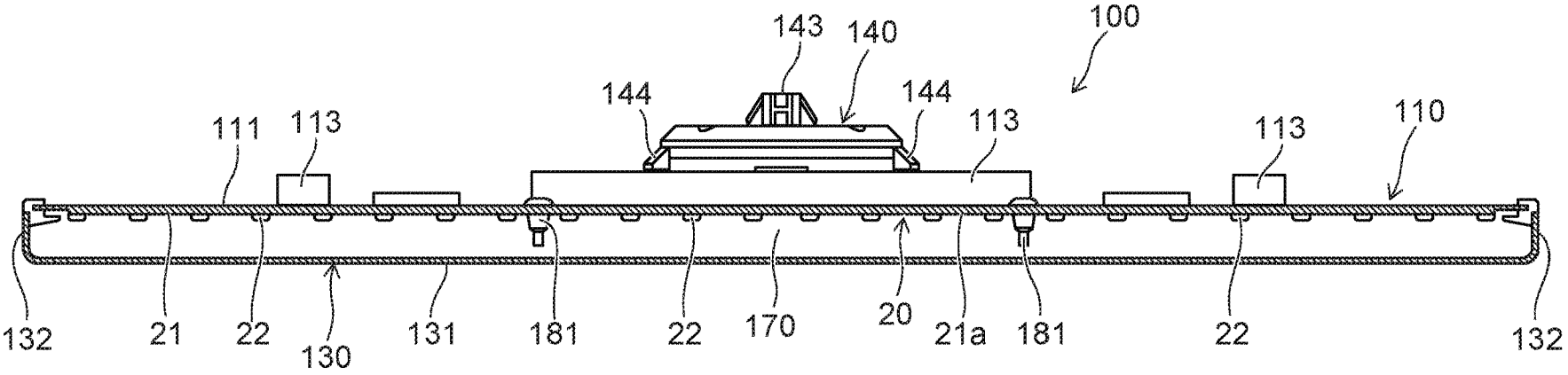
FIG. 18 is a schematic cross-sectional view of the light fixture of the second embodiment.

FIG. 18 is a schematic cross-sectional view of the light fixture 100.

The light fixture 100 includes a light fixture main body 110 and a mounting adapter 140. The light fixture main body 110 includes a metal plate 111. As shown in FIG. 17, the mounting adapter 140 is provided at the back surface of the metal plate 111. For example, the mounting adapter 140 is fixed to the back surface of the metal plate 111 by screws. For example, the mounting adapter 140 has a truncated circular conical shape. For example, a light fixture-side connector 143 having a socket structure is fixed to the upper surface of the mounting adapter 140.

A metal stay 114 that reinforces the light fixture main body 110 is provided at the back surface of the metal plate 111. For example, two metal stays 114 extend along one side of the quadrilateral metal plate 111. The two metal stays 114 are separated from each other in a direction orthogonal to their extension direction, and are symmetrically arranged with respect to the mounting adapter 140 provided at the central portion of the metal plate 111. A cushion material 113 is also provided at the back surface of the metal plate 111.

The light fixture main body 110 further includes the light source module 20 and a cover 130 having light transmissivity. The light source module 20 has a configuration and characteristics similar to those of the light source module 20 of the first embodiment as shown in FIG. 4, FIG. 5, FIG. 6 and FIG. 27. The light source module 20 of the second embodiment is mounted to the surface on the side opposite to the back surface of the metal plate 111, and the cover 130 is mounted to the metal plate 111 to cover the light source module 20. The metal plate 111 functions as a reinforcing plate and a heat dissipation plate of the light source module 20.

Similarly to the first embodiment, the light-emitting elements 23 of the light source module 20 are mounted to the light source arrangement surface 21*a* of the substrate 21. Also, the electrodes of the light-emitting elements 23 are electrically connected to a conductor pattern formed on the substrate 21. The conductor pattern that is formed on the substrate 21 also is electrically connected to the light fixture-side connector 143 provided at the upper surface of the mounting adapter 140 of the second embodiment.

The cover 30 is transmissive to the light emitted by the light sources 22. For example, the cover 30 is a light-diffusing translucent white member in which titanium oxide or the like is dispersed in a resin material. The cover 30 is flexible.

As shown in FIG. 18, the cover 130 has a light transmissive side surface 131 and lateral surface portions 132. The light transmissive side surface 131 faces the light sources 22, and is separated from the light sources 22 by a space 170. The lateral surface portions 132 are provided to be continuous at the end portions of the light transmissive side surface 131, and covers the lateral sides of the space 170.

The light fixture main body 110 includes multiple protrusions 181. The protrusions 181 protrude from the light source arrangement surface 21*a* toward the light transmissive side surface 131 of the cover 130, while being disposed inside the space 170, and having a gap between the light transmissive side surface 131 and the protrusions 181.

The heights of the protrusions 181 from the light source arrangement surface 21*a* are greater than the heights from the light source arrangement surface 21*a* of the light sources 22.

As shown in FIG. 27, among the multiple protrusions 181, at least two of the protrusions 181 are positioned in an area (i.e., illustrated by the broken line) of the surface of the main body defined by an interface between the mounting adapter 140 and the back side surface of the main body (for example, back side surface 13 of FIG. 1 or back side surface 21*b* of FIG. 4). The protrusions extend from the surface of main body in a direction in which the light source arrangement surface 21*a* extends. In the example shown in FIG. 27, four protrusions 181 are provided at the periphery of the area where the mounting adapter 140 is positioned.

The distances are equal between mutually adjacent ones of the protrusions 181 along the side of the light source arrangement surface 21*a*. The distances are equal between the center of the mounting adapter 140 and the protrusions 181. The distances between the center of the mounting adapter 140 and the protrusions 181 are shorter than the distances between the corners of the light source arrangement surface 21*a* and the protrusions 181. The distances between the center of the mounting adapter 140 and the protrusions 181 are shorter than the shortest distance between the sides of the light source arrangement surface 21*a* and the protrusions 181.

The protrusion 181 is formed using a transmissive material and is, for example, translucent white or semi-transparent. For example, the protrusion 181 is formed using a resin material. The protrusion 181 is not in contact with the light transmissive side surface 131 of the cover 130. Accordingly, the protrusion 181 does not appear as a shadow when the cover 130 is viewed from the outside by a human. The protrusion 181 does not affect the light emission characteristics.

Figure 19:
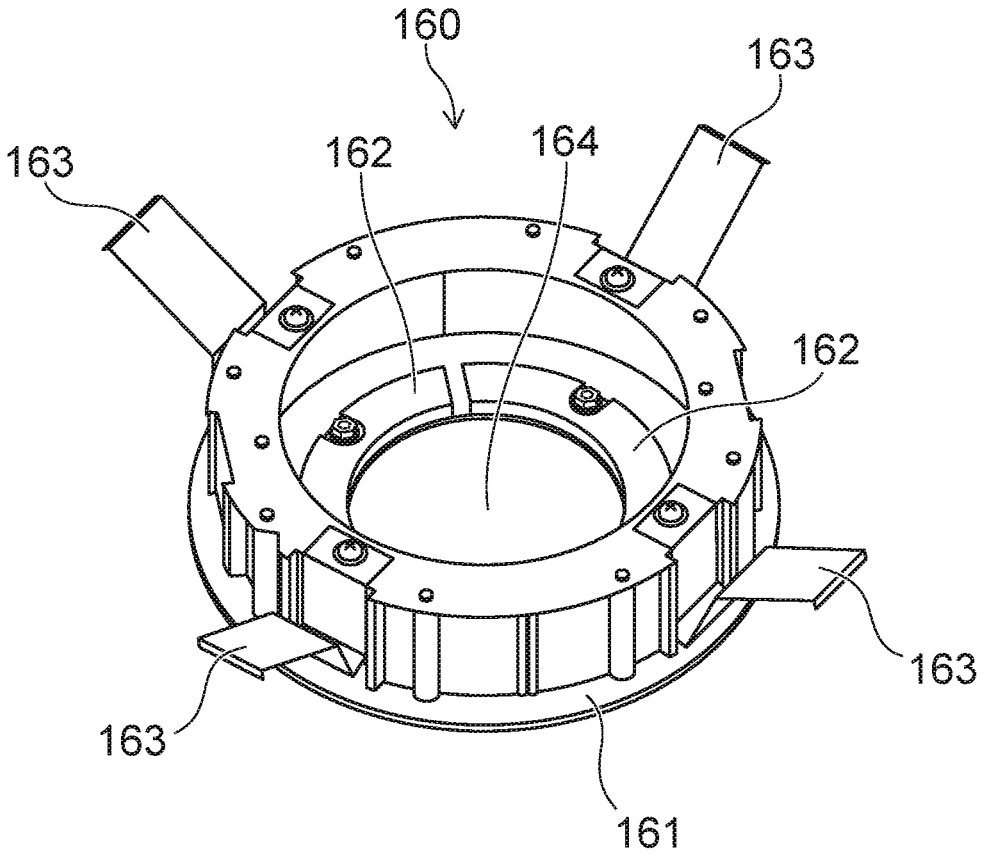
FIG. 19 is a perspective view of a mounting bracket of the second embodiment.

The light fixture 100 of the second embodiment is mounted to the ceiling 300 by a mounting bracket 160. FIG. 19 is a perspective view of the mounting bracket 160.

The mounting bracket 160 is formed in a ring shape and defining an opening 164 inside the ring shape. Multiple mounting springs 163 each having a plate-spring structure are provided at the lateral surface of the mounting bracket 160. A flange 161 that has a ring shape is provided at the lower surface of the mounting bracket 160. The outer diameter of the flange 161 is larger than the diameter of a circular mounting hole formed in the ceiling 300. A backing plate 162 is provided along the rim of the opening 164 at the upper surface of the flange 161.

The mounting bracket 160 is fitted into the mounting hole 300*a* formed in the ceiling 300.

Figure 20:
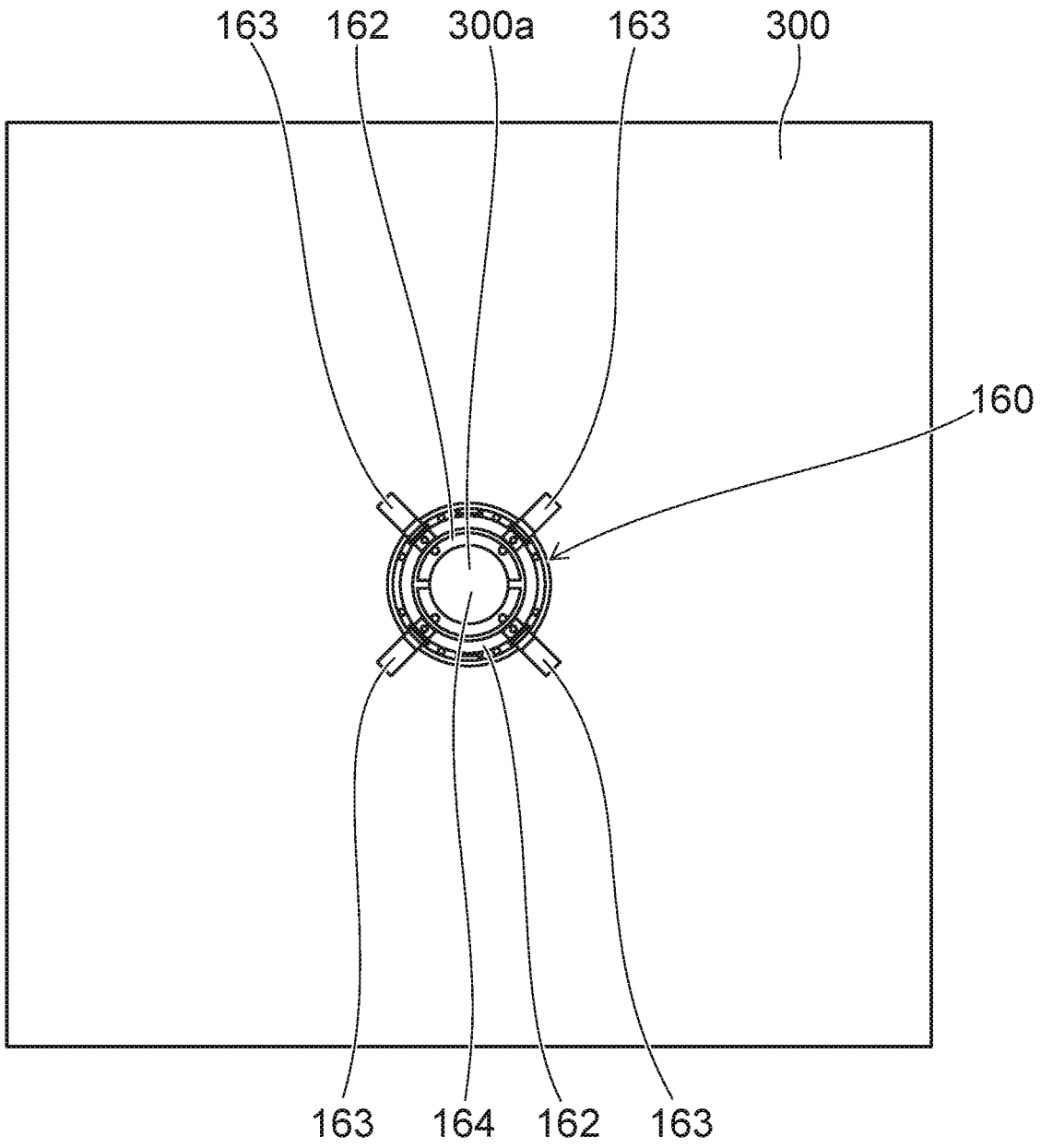
FIG. 20 is a top view of the mounting bracket of the second embodiment fitted into a mounting hole of the ceiling.

FIG. 20 is a top view of the mounting bracket 160 fitted into the mounting hole 300*a* of the ceiling 300. FIG. 20 illustrates the backside of the ceiling 300.

Figure 21:
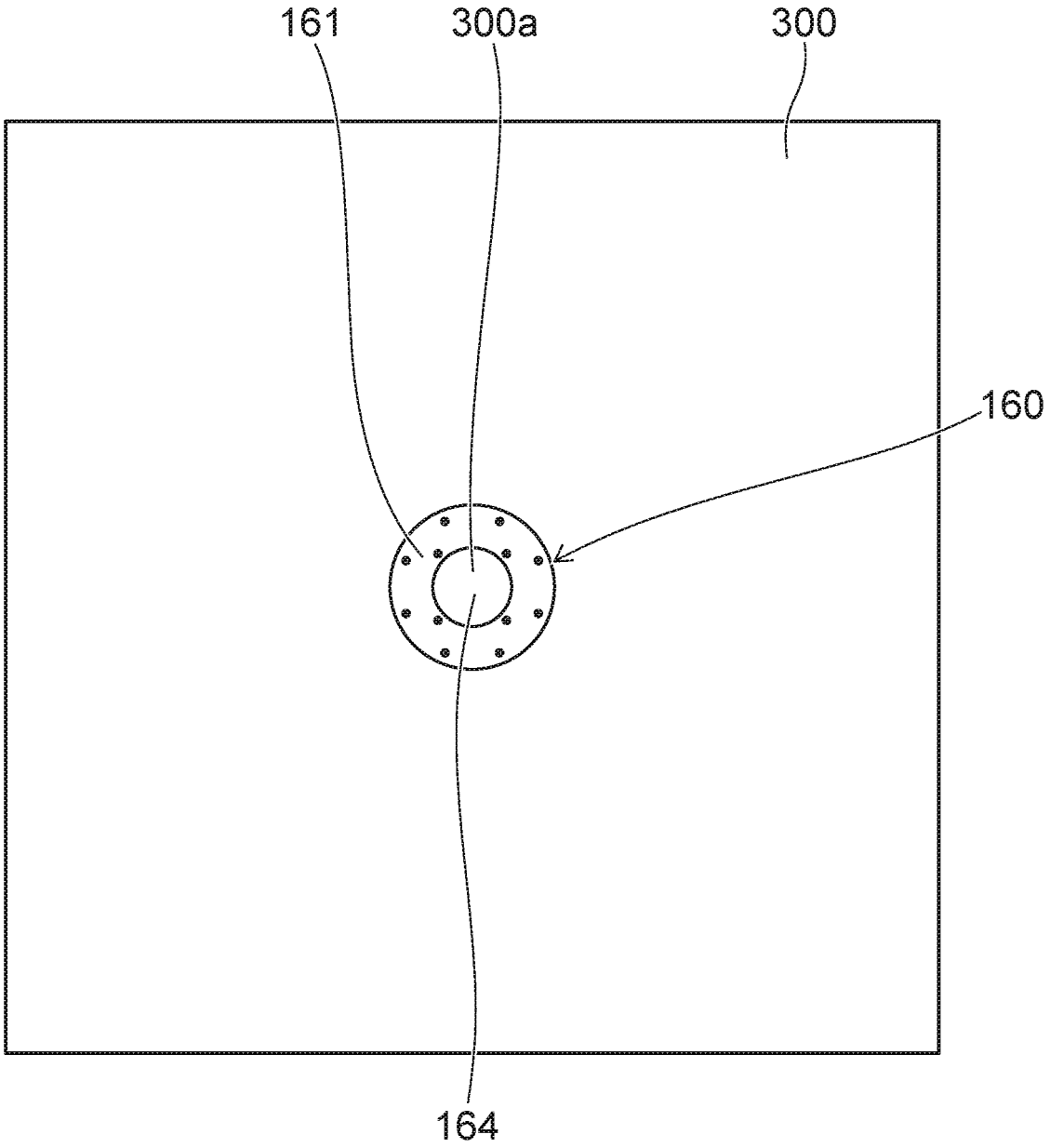
FIG. 21 is a bottom view of the mounting bracket of the second embodiment fitted into the mounting hole of the ceiling.

FIG. 21 is a bottom view of the mounting bracket 160 fitted into the mounting hole 300*a* of the ceiling 300. FIG. 21 illustrates the front side of the ceiling 300 facing the space to be illuminated.

The mounting springs 163 are disposed between the lateral surface of the mounting bracket 160 and the inner wall of the mounting hole 300*a* in a state in which the mounting springs 163 are deformed from the unstressed state. The mounting bracket 160 is moved upward by the restoring force of the mounting springs 163, and the mounting bracket 160 is maintained in the state of being fitted into the mounting hole 300*a* by the upper surface of the flange 161 being pressed onto the surface on the front side of the ceiling 300 (referring to FIG. 23).

If necessary, a power supply unit 150 shown in FIG. 16 is disposed on the backside of the ceiling 300 before fitting the mounting bracket 160 into the mounting hole 300*a* of the ceiling 300. The power supply unit 150 passes through the mounting hole 300*a* to the backside of the ceiling 300, and is disposed on the backside of the ceiling 300 at a position not overlapping the mounting hole 300*a* in a top view of the light fixture main body 10.

Alternatively, in the case where a power supply unit 150 already mounted on the backside of the ceiling 300 is used as it is, the mounting step of the power supply unit 150 in the backside of the ceiling 300 is unnecessary.

As shown in FIG. 16, the power supply unit 150 includes terminal blocks 152 and 153 that are connectable to an external power supply (i.e., a commercial power source). An electrical cable 151 is drawn from the power supply unit 150. The terminals of the terminal blocks 152 and 153 are electrically connected to the circuit board of the power supply unit 150, and the electrical cable 151 is electrically connected to the circuit board. A power supply-side connector 151*a* is provided at an end portion of the electrical cable 151.

In the state before mounting the light fixture main body 110 to the ceiling 300, the electrical cable 151 passes through the mounting hole 300*a* of the ceiling 300 and the opening 164 inside the mounting bracket 160 fitted into the mounting hole 300*a*, and the power supply-side connector 151*a* is positioned on the front side of the ceiling 300.

The worker for mounting the light fixture 100 bring the light fixture 100 close to the ceiling 300, while holding the light fixture 100 with one hand. At the same time, the worker grasps the power supply-side connector 151*a* of the electrical cable 151 hanging down from the mounting hole 300*a* with the other hand. Then the worker connects the power supply-side connector 151*a* to the light fixture-side connector 143 fixed to the upper surface of the mounting adapter 140 provided at the back side surface of the light fixture main body 110 (for example, back side surface 13 of FIG. 1 or back side surface 21*b* of FIG. 4).

After the power supply-side connector 151*a* is connected to the light fixture-side connector 143, the mounting adapter 140 is fitted into the opening 164 inside the mounting bracket 160 fitted into the mounting hole 300*a* of the ceiling 300.

Figure 22:
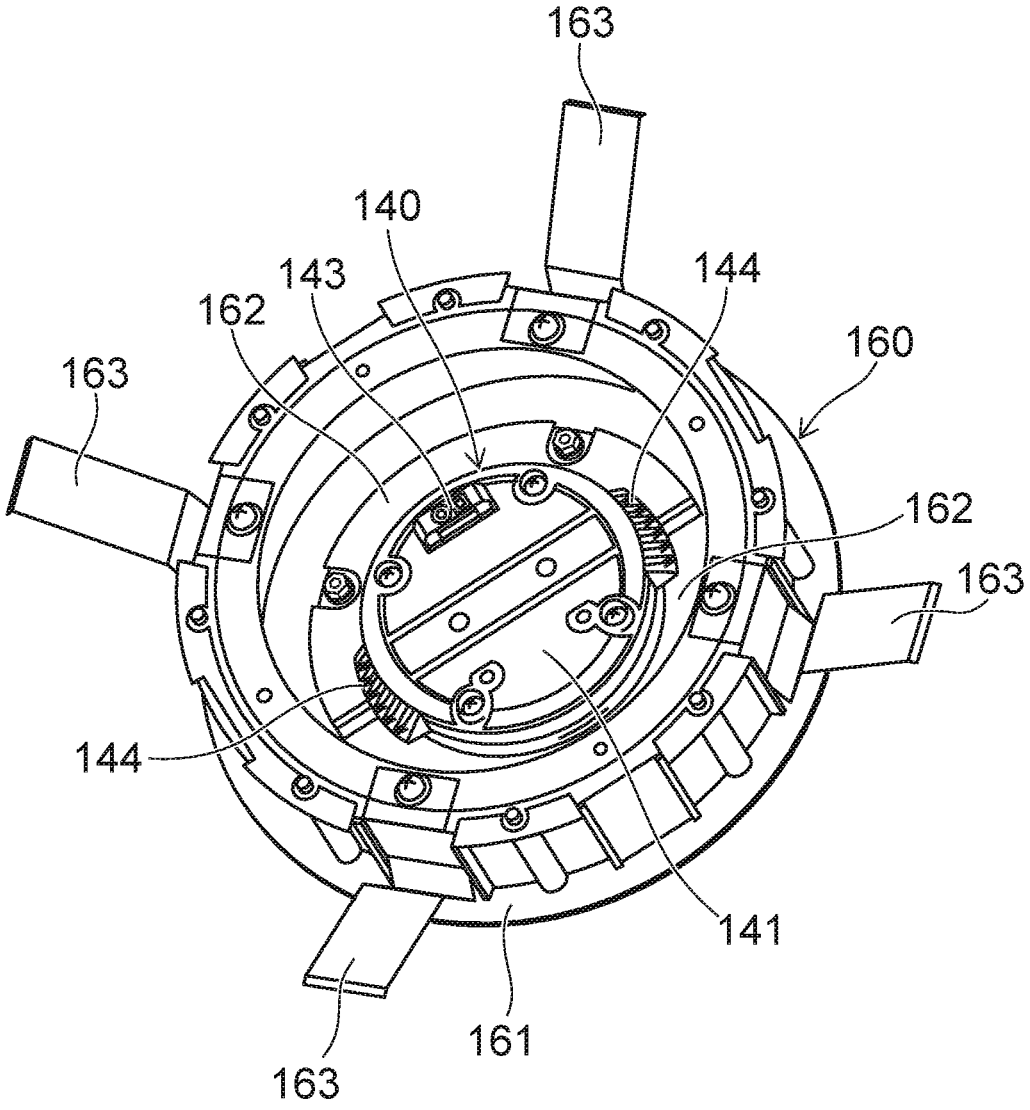
FIG. 22 is a perspective view illustrating a structure in which the mounting bracket is mated with the mounting adapter according to the second embodiment.

FIG. 22 is a perspective view illustrating the mated structure of the mounting bracket 160 and the mounting adapter 140.

Figure 23:
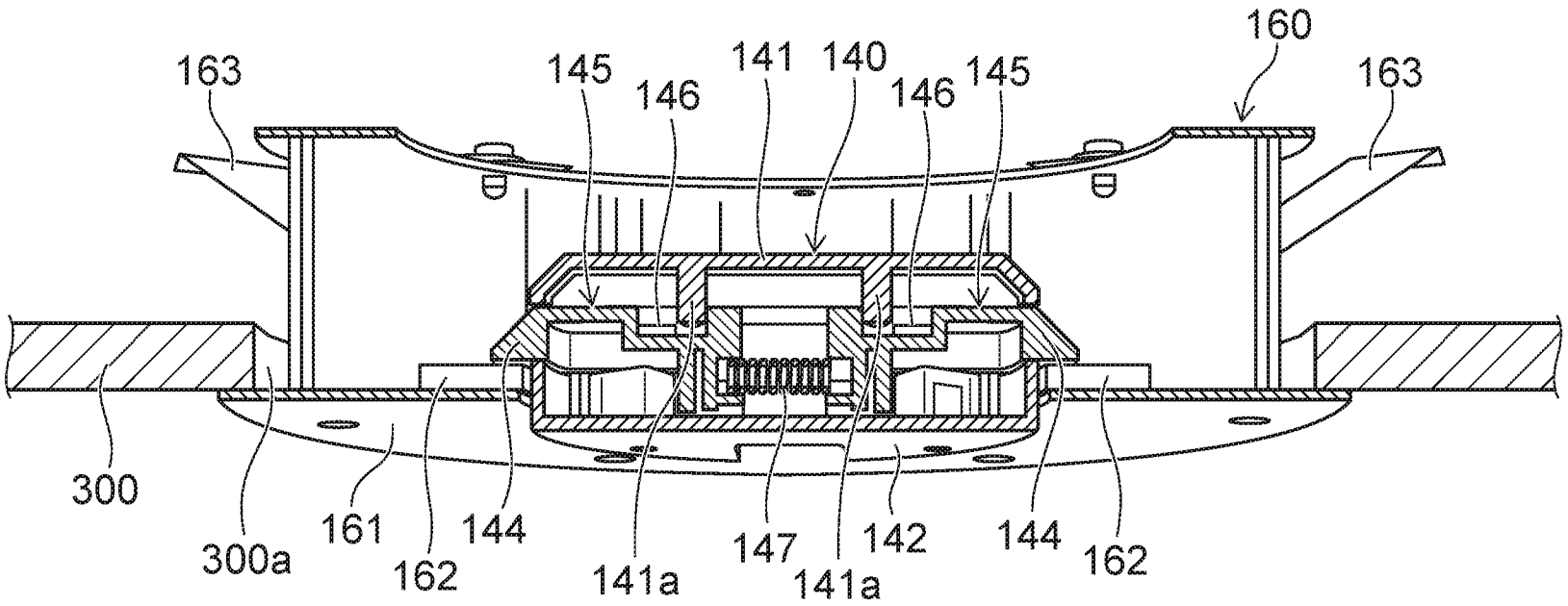
FIG. 23 is a cross-sectional perspective view illustrating the structure in which the mounting bracket is mated with the mounting adapter according to the second embodiment.

FIG. 23 is a cross-sectional perspective view illustrating the mated structure of the mounting bracket 160 and the mounting adapter 140.

The mounting adapter 140 includes an upper case 141, a lower case 142, two sliding members 145, and a spring 147 linking the two sliding members 145.

A tab portion 144 that has an inclined surface is provided at the tip of each of the sliding members 145. By the sliding of the two sliding members 145 as the spring 147 expands and contracts, the tab portions 144 can retract into the cases 141 and 142, and can protrude outside the cases 141 and 142 through openings formed between the upper case 141 and the lower case 142.

FIG. 22 and FIG. 23 show a state in which the tab portions 144 protrude outside the cases 141 and 142 and extend onto the upper surface of the backing plate 162 of the mounting bracket 160. As shown in FIG. 23, a stopper 141*a* that protrudes downward from the upper case 141 is positioned inside recesses 146 formed in the upper surfaces of the sliding members 145, Also, the movement of the two sliding members 145 away from each other is limited by the stopper 141*a* being in contact with the wall surfaces of the recesses 146.

Normally, the tab portions 144 protrude outside the cases 141 and 142. When the mounting adapter 140 is fitted into the mounting bracket 160, the inclined surfaces of the tab portions 144 are brought into contact with the inner perimeter wall of the backing plate 162 and the inner perimeter wall of the flange 161 of the mounting bracket 160. Due to the forces applied on the tab portions 144 from the inner perimeter wall of the flange 161 and the inner perimeter wall of the backing plate 162, the two sliding members 145 slide to approach each other by compressing the spring 147. The tab portions 144 retract into the cases 141 and 142, which allows the mounting adapter 140 to fit into the mounting bracket 160.

Then, when the tab portions 144 move to a position higher than the backing plate 162, the forces applied on the tab portions 144 from the inner perimeter wall of the backing plate 162 are released. Therefore, the two sliding members 145 are moved away from each other by the restoring force of the spring 147. The tab portions 144 protrude outside the cases 141 and 142, and the lower surfaces of the tab portions 144 extend onto the upper surface of the backing plate 162. This can prevent the mounting adapter 140 and the light fixture main body 110 fixed to the mounting adapter 140 from falling from the mounting bracket 160.

In the state in which the mounting adapter 140 is fitted into the mounting bracket 160, the cushion material 113 that is provided at the back surface of the metal plate 111 shown in FIG. 17 is securely in contact with the surface on the front side of the ceiling 300. As shown in FIG. 14, the light transmissive side surface 131 of the cover 130 is parallel to the front-side surface of the ceiling 300, and faces the space below the ceiling 300.

Alternatively, the light fixture 100 of the second embodiment may be mounted to a wall material by a method the same as or a similar to the method of mounting to the ceiling 300. After the light fixture 100 is mounted to a wall material, the light transmissive side surface 131 of the cover 130 is parallel to the wall surface, and faces the lateral-side space of the wall material.

The multiple light sources 22 of the light source module 20 are arranged over a region that is larger than the plane area of the mounting hole 300*a* of the ceiling 300 and the plane area of the opening 164 of the mounting bracket 160. The light sources 22 are disposed also in the region of the light fixture main body 110 overlapping the mounting adapter 140 in a top view of the light fixture main body 110. This enables light emission from the central portion of the light transmissive side surface 131 which is the region overlapping the mounting hole 300*a* and the mounting adapter 140. Thus the light-emitting surface can be obtained over a wide surface area.

In the state in which the mounting adapter 140 is fitted into the mounting bracket 160 as shown in FIG. 16, the upper surface of the mounting adapter 140 and the connection portion between the power supply-side connector 151*a* and the light fixture-side connector 143 are exposed in the space on the ceiling 300 backside. The mounting adapter 140 is fixed to the mounting bracket 160 so that the upper surface of the mounting adapter 140 is exposed in the space on the ceiling 300 backside. The power supply unit 150 is disposed at a position not overlapping the mounting adapter 140 in a top view of the light fixture main body 110, and does not cover the mounting adapter 140. Therefore, the heat generated by the light source module 20 can be dissipated in the space on the backside of the ceiling 300 via the mounting adapter 140.

The worker fits the mounting adapter 140 into the mounting bracket 160 by pushing up the central portion in the front-side surface of the light transmissive side surface 131 of the cover 130 (i.e., the area where the mounting adapter 40 is positioned) by hand.

Figure 24:
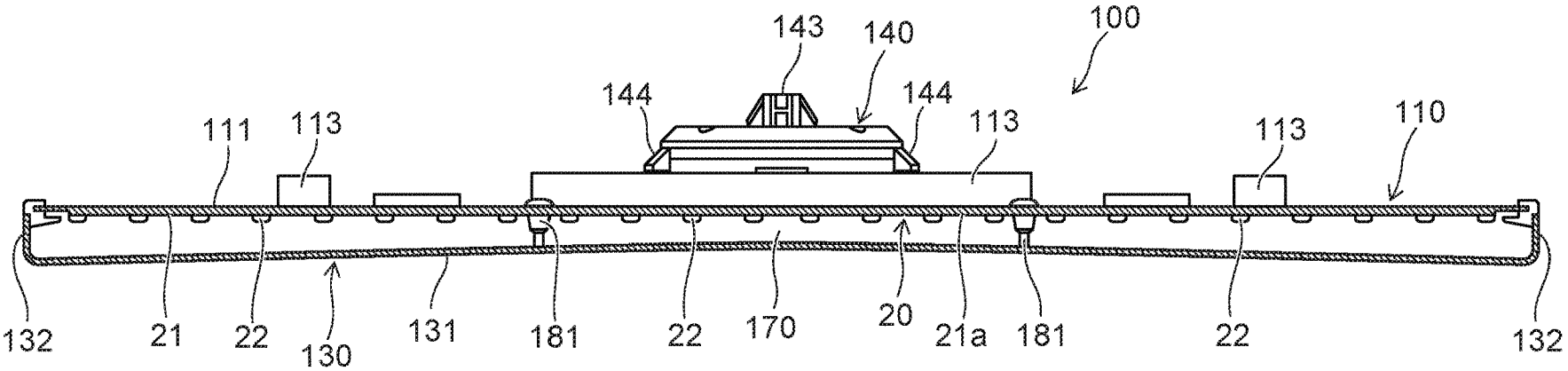
FIG. 24 is a schematic cross-sectional view illustrating a method of mounting the light fixture of the second embodiment.

At this time, as shown in FIG. 24, the central portion of the light transmissive side surface 131 of the cover 130 warps to be concave toward the mounting adapter 140 side, and the back surface of the light transmissive side surface 131 is in contact with the protrusions 181. The load applied to the light transmissive side surface 131 is transmitted to the mounting adapter 140 via the protrusions 181. Thus, the mounting adapter 140 can be fitted into the mounting bracket 160.

As shown in FIG. 27, the multiple protrusions 181 are arranged at similar intervals in the periphery of the mounting adapter 140, and thus the load can be applied uniformly without a bias to the mounting adapter 140. Accordingly, the mounting adapter 140 easily can be fitted into the mounting bracket 160.

When the light transmissive side surface 131 of the cover 130 is pressed, the protrusions 181 serve as stoppers, and limit the displacement of the light transmissive side surface 131 beyond the protrusions 181, and the light transmissive side surface 131 is not in contact with the light sources 22. This can mitigate the damage of the cover 130 and the light sources 22.

In the first embodiment as well, as shown in FIG. 27, for example, the four protrusions 181 are provided at the periphery of the area where the mounting adapter 40 is positioned. Therefore, when fitting the mounting adapter 40 shown in FIG. 12 to FIG. 13 into the power supply adapter 50, the back surface of the light transmissive side surface 31 of the cover 30 is in contact with the protrusions 181. The load applied to the light transmissive side surface 31 is transmitted to the mounting adapter 40 via the protrusions 181. Thus the mounting adapter 40 can be fitted into the power supply adapter 50. Also, the protrusions 181 can attenuate damage of the cover 30 and the light sources 22 caused by an impact between the cover 30 and the light sources 22.

A method of detaching the light fixture 100 from the ceiling 300 will now be described.

As shown in FIG. 17, a detaching member 112 is provided at the back surface of the metal plate 111. One end portion 112*c* of the detaching member 112 is exposed at the lateral surface of the light fixture main body 110. The worker can grasp the one end portion 112*c* of the detaching member 112 using fingers or a jig in the state in which the light fixture main body 110 is mounted to the ceiling 300. The other end portion of the detaching member 112 is linked to the sliding member 145 of the mounting adapter 140.

Figure 25:
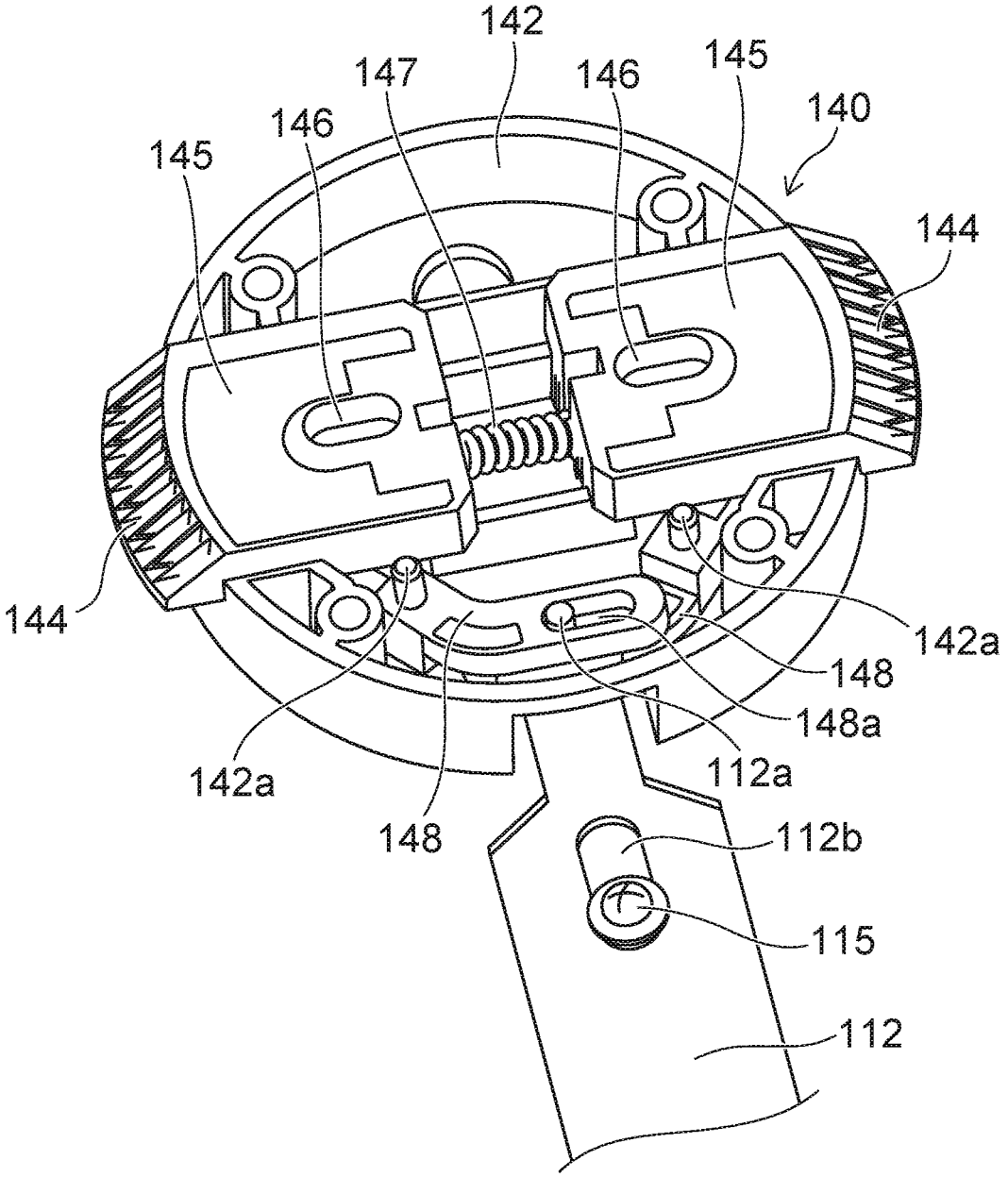
FIG. 25 and FIG. 26 are perspective views illustrating a linking structure between the mounting adapter and a detaching member of the second embodiment.
Figure 26:
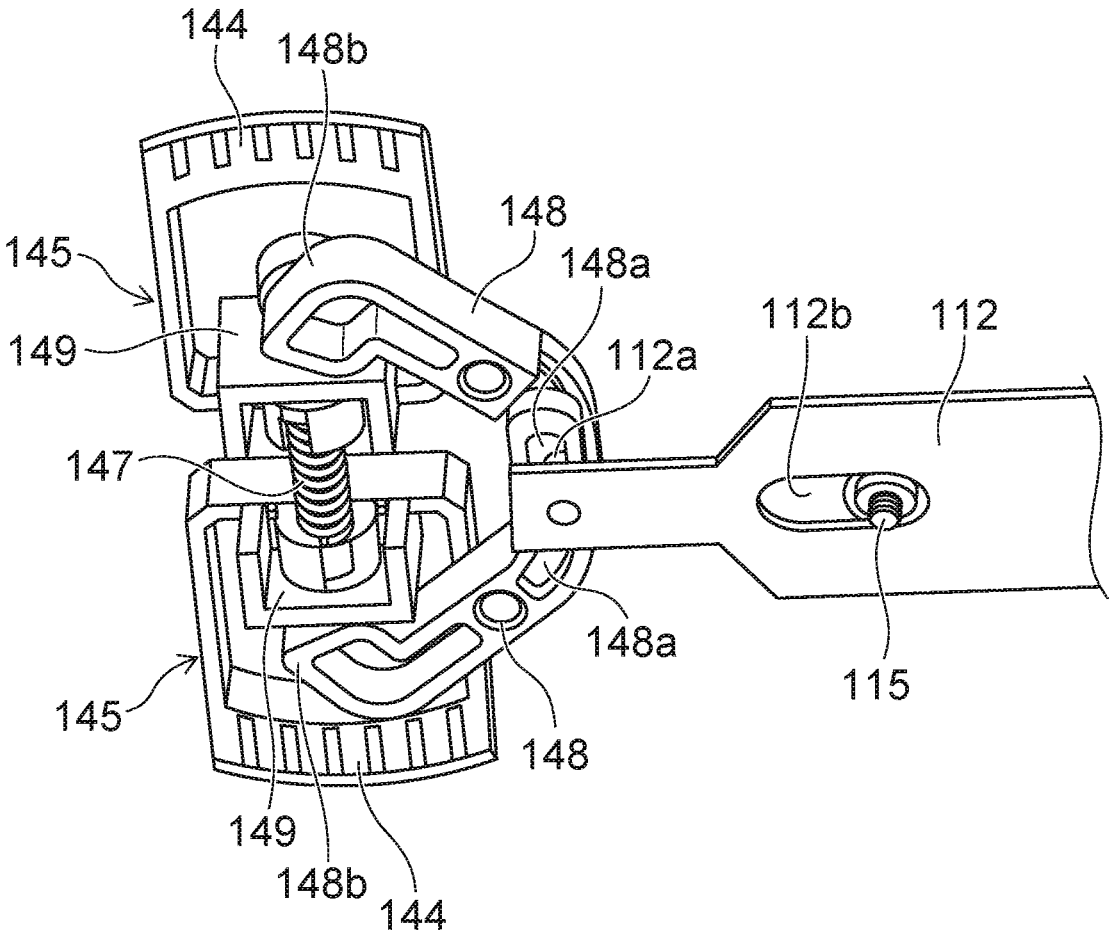

FIG. 25 and FIG. 26 are perspective views respectively illustrating a linking structure between the mounting adapter 140 and the detaching member 112.

FIG. 25 shows the linking structure in a state in which the upper case 141 of the mounting adapter 140 is removed.

FIG. 26 is a perspective backside view of the linking structure of the detaching member 112 and the sliding members 145, in the state where the lower case 142 shown in FIG. 25 is also removed.

The detaching member 112 and the sliding members 145 are linked by two arm members 148. Each of the arm members 148 can be rotated with an axial portion 142*a* provided in the lower case 142 as a fulcrum.

A through-hole 148*a* is formed in one end portion of each of the arm members 148. A pin 112*a* provided in the other end of the detaching member 112 engages the interiors of the through-holes 148*a*.

A long hole 112*b* is formed in the detaching member 112. A screw 115 is positioned inside the long hole 112*b*. The screw 115 is mounted to the metal plate 111. For example, the worker can slide the detaching member 112 along the longitudinal direction of the detaching member 112 by pulling the one end portion 112*c* of the detaching member 112 using a jig. At this time, the sliding of the detaching member 112 is guided by the contact between the inner wall and the screw 115 of the long hole 112*b*.

When the detaching member 112 is pulled in a direction that the one end portion 112*c* of the detaching member 112 juts from the light fixture main body 110, the pair of the arm members 148 engaging the pin 112*a* of the detaching member 112 rotate with the axial portion 142*a* as a fulcrum. The rotations of the arm members 148 allows other end portions 148*b* of the arm members 148 shown in FIG. 26 to press on protruding portions 149 provided at the lower surface of the sliding members 145. Then, the two sliding members 145 slide to approach each other by causing the spring 147 to compress.

The sliding of the sliding members 145 releases the state in which the tab portions 144 extend onto the backing plate 162 of the mounting bracket 160 shown in FIG. 23. Thus, the mounting adapter 140 is released from the mounting bracket 160; and the light fixture main body 110 can be detached from the ceiling 300.

The one end portion 112*c* of the detaching member 112 is bent inside the light fixture main body 110, and the jig can catch on the one end portion 112*c*. The position of the one end portion 112*c* of the detaching member 112 is aligned with a notch formed in the lateral surface of the cover 130, and is exposed at the lateral surface of the light fixture main body 110.

The detaching member 112 is a metal member, and the metal member is painted to be the same color or nearly the same color as the color of the cover 130 (e.g., translucent white). For example, the detaching member 112 is painted in white. Therefore, the one end portion 112*c* of the detaching member 112 is not too noticeable at the lateral surface of the light fixture main body 110 particularly when turned off, and the quality of the external appearance is not lost.

The mating mechanism and the detaching mechanism of the mounting adapter 140 with respect to the mounting bracket 160 of the second embodiment are also applied to the mating mechanism and the detaching mechanism of the mounting adapter 40 with respect to the power supply adapter 50 of the first embodiment.

According to the second embodiment described above, mounting of the light fixture main body 110 to the ceiling 300 can be sufficiently performed by making only one mounting hole 300*a* that is smaller than the size of the light fixture main body 110 and matches the size of the mounting adapter 140, without necessity of making a polygonal hole matching the shape and the size of the light fixture main body 110 in the building material. Then, the mounting adapter 140 is fitted into the mounting bracket 160 fitted into the mounting hole 300*a*, to thereby easily mount the light fixture main body 110 in the ceiling 300.

The light fixture-side connector 143 is fixed to the upper surface of the mounting adapter 140, and does not dangle from one end of a cable. On the other hand, the power supply-side connector 151*a* is leaded out from the power supply unit 150 using the electrical cable 151. The power supply-side connector 151*a* can be positioned on the front side of the ceiling 300 within reach of the worker by passing the power supply-side connector 151*a* through the mounting hole 300*a* of the ceiling 300 and the opening 164 of the mounting bracket 160. Then the worker can connect the power supply-side connector 151*a* to the light fixture-side connector 143 by grasping the power supply-side connector 151*a* with one hand while supporting the light fixture 100 by placing the other hand on the light transmissive side surface 31 of the cover 30 of the light fixture 100. It is unnecessary to grasp the light fixture-side connector 143 itself by hand. Therefore, the electrical connection between the power supply unit 150 and the light fixture 100 and the mounting of the light fixture 100 to the ceiling 300 can be performed easily by one worker even when the planar size of the light fixture main body 110 is large.

The light fixture 100 can be detached from the ceiling 300 by releasing the engagement between the mounting bracket 160 and the tab portions 144 of the mounting adapter 140 by using a jig to pull the one end of the detaching member 112 described above with one hand while supporting the light fixture 100 by placing the other hand on the light transmissive side surface 31 of the light fixture 100. Subsequently, while maintaining the state in which the light fixture 100 is supported by the other hand, the power supply-side connector 151*a* can be released from the light fixture-side connector 143 by moving the one hand from the detaching member 112 to the power supply-side connector 151*a* and by pulling the power supply-side connector 151*a*. In other words, the detachment from the ceiling 300 of the light fixture 100 and the release of the electrical connection between the power supply unit 150 and the light fixture 100 can be performed easily by one worker.

According to such a second embodiment, because a variety of product types of the light fixture main body 110 are applicable for easy connection to a common power supply unit 150 by a one-touch operation, the replacement to the other types of the light fixture main body 110 is possible without trouble. When replacing the light fixture main body 110, it is unnecessary to detach the common power supply unit 150 from the ceiling 300.

The mounting bracket 160 is formed in a ring shape, and the top of the ring shape is open but not closed. Accordingly, after the power supply-side connector 151*a* is connected to the light fixture-side connector 143, when fitting the mounting adapter 140 into the mounting bracket 160, the electrical cable 151 can retreat into the space above the mounting bracket 160 without being pinched or snagging on something. Thus, the work of fitting the mounting adapter 40 into the mounting bracket 160 is not impeded.

The embodiments of the present disclosure have been described with reference to specific examples. However, the present disclosure is not limited to these specific examples. Based on the above-described embodiments of the present disclosure, all embodiments that can be implemented with appropriately design modification by one skilled in the art are also within the scope of the present disclosure as long as the gist of the present disclosure is included. Besides, within the scope of the spirit of the present disclosure, one skilled in the art can conceive various modifications, and the modifications fall within the scope of the present disclosure.

What is claimed is:

1. A light fixture assembly for mounting on a mounting surface of a building material, the light fixture assembly comprising:

a light fixture comprising:

a main body comprising a back side surface and a light transmissive side surface opposing the back side surface, the main body having a first dimension from a first lateral edge to a second lateral edge opposing the first lateral edge that is greater than a second dimension from the back side surface to the light transmissive side surface, a mounting adapter provided at the back side surface, and a plate spring provided at the back side surface and extending along a first direction from the first lateral edge to the second lateral edge, wherein, the plate spring is configured to apply a restoring force to the first lateral edge and the second lateral edge.

2. The light fixture assembly according to claim 1, the light fixture assembly comprising:

a housing comprising an opening in at least one side of the housing and an interior space, the housing configured to be mounted to the mounting surface, wherein, the mounting adapter comprises physical dimensions such that the mounting adapter fits into the at least one opening and the interior space of the housing, and the mounting adapter is configured to be mounted to the housing.

3. The light fixture assembly according to claim 2, wherein the restoring force acts on the first lateral edge and the second lateral edge in a second direction orthogonal to the first direction.

4. The light fixture of assembly according to claim 3, wherein the second direction extends from the light fixture main body to the mounting adapter.

5. The light fixture assembly according to claim 3, wherein the second direction extends from the light transmissive side surface to the back side surface.

6. The light fixture assembly according to claim 2, wherein a back side surface of the plate spring is configured to be adjacent the mounting surface.

7. The light fixture assembly according to claim 1, wherein the plate spring is affixed to the back side surface at a point configured to act as a fulcrum about which the plate spring exerts the restoring force.

8. The light fixture assembly according to claim 1, wherein the plate spring comprises a glass-containing resin member.

9. The light fixture assembly according to claim 2, wherein the light transmissive side surface is configured to be substantially parallel to the mounting surface when the light fixture assembly is mounted.

10. The light fixture assembly according to claim 2, wherein the housing comprises a tubular portion.

11. A light fixture assembly for mounting on a mounting surface of a building material, the light fixture assembly comprising:

a light fixture comprising:

a main body comprising a back side surface and a light transmissive side surface opposing the back side surface, the main body having a first dimension from a first lateral edge to a second lateral edge opposing the first lateral edge that is greater than a second dimension from the back side surface to the light transmissive side surface, a mounting adapter provided at the back side surface, the mounting adapter being smaller than the main body when viewed from a direction perpendicular to the back side surface, and a plurality of light sources provided on a surface of the main body that is between the back side surface and the light transmissive side surface, the plurality of light sources arranged to emit light towards the light transmissive side surface, the plurality of light sources arranged in a region overlapping the mounting adapter when viewed from the direction perpendicular to the back side surface, a plurality of protrusions provided on the surface of the main body and arranged laterally between the plurality of light sources.

12. The light fixture assembly according to claim 11, wherein the plurality of protrusions extend towards the light transmissive surface and form a gap between a tip of each of the plurality of protrusions and the light transmissive side surface.

13. The light fixture assembly according to claim 11, wherein the plurality of protrusions extend beyond a tip of each of the plurality of light sources in a direction towards the light transmissive side surface.

14. The light fixture assembly according to claim 11, wherein at least two of the plurality of protrusions are disposed in an area of the surface of the main body defined by an interface between the mounting adapter and the back side surface of the main body.

15. The light fixture assembly according to claim 11, wherein the plurality of protrusions are substantially evenly spaced in a direction from the first lateral edge to the second lateral edge of the main body.

16. The light fixture assembly according to claim 11, wherein the plurality of protrusions are configured to transmit a load applied to the light transmissive side surface to the mounting adapter during mounting of the light fixture assembly.

17. The light fixture assembly according to claim 15, wherein the plurality of protrusions are configured to transmit uniformly a load applied to the light transmissive side surface to the mounting adapter during mounting of the light fixture assembly.

18. The light fixture assembly according to claim 11, wherein the plurality of protrusions are configured to prevent damage to the plurality of light sources.

19. The light fixture assembly according to claim 11, wherein the plurality of protrusions comprise a light transmissive material.

20. The light fixture assembly according to claim 19, wherein the plurality of protrusions comprise a resin material.

* * * * *